US009494882B2

(12) United States Patent
Yamagishi et al.

(10) Patent No.: US 9,494,882 B2
(45) Date of Patent: Nov. 15, 2016

(54) METHOD OF PRODUCING ELECTROPHOTOGRAPHIC PHOTOSENSITIVE MEMBER

(71) Applicant: CANON KABUSHIKI KAISHA, Tokyo (JP)

(72) Inventors: Keiko Yamagishi, Kawasaki (JP); Harunobu Ogaki, Suntou-gun (JP); Kimihiro Yoshimura, Yokohama (JP); Hiroki Uematsu, Mishima (JP); Yohei Miyauchi, Tokyo (JP); Atsushi Okuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/405,139

(22) PCT Filed: May 22, 2013

(86) PCT No.: PCT/JP2013/064958
§ 371 (c)(1),
(2) Date: Dec. 2, 2014

(87) PCT Pub. No.: WO2013/183526
PCT Pub. Date: Dec. 12, 2013

(65) Prior Publication Data

US 2015/0147693 A1 May 28, 2015

(30) Foreign Application Priority Data

Jun. 4, 2012 (JP) ..... 2012-127139
Apr. 23, 2013 (JP) ..... 2013-090806

(51) Int. Cl.

| | |
|---|---|
| ***G03G 5/026*** | (2006.01) |
| ***G03G 5/06*** | (2006.01) |
| ***G03G 5/05*** | (2006.01) |
| ***G03G 5/043*** | (2006.01) |

(52) U.S. Cl.
CPC ..... *G03G 5/0629* (2013.01); *G03G 5/043* (2013.01); *G03G 5/05* (2013.01); *G03G 5/0514* (2013.01); *G03G 5/0525* (2013.01); *G03G 5/0614* (2013.01); *G03G 5/0616* (2013.01)

(58) Field of Classification Search
CPC ..... G03G 5/50525
See application file for complete search history.

(56) References Cited

U.S. PATENT DOCUMENTS

2012/0296568 A1* 11/2012 Klenkler ..... G03G 5/047 702/1

FOREIGN PATENT DOCUMENTS

| | | | |
|---|---|---|---|
| JP | 63-192048 | A | 8/1988 |
| JP | H06-123987 | A | 5/1994 |
| JP | H09-160263 | A | 6/1997 |
| JP | 2000-221701 | A | 8/2000 |
| JP | 2000-267309 | A | 9/2000 |
| JP | 2006-330048 | A | 12/2006 |
| JP | 2007-199590 | A | 8/2007 |
| JP | 2009-282463 | A | 12/2009 |

* cited by examiner

*Primary Examiner* — Hoa V Le
(74) *Attorney, Agent, or Firm* — Canon U.S.A., Inc., IP Division

(57) ABSTRACT

The invention has a process of preparing a dispersion liquid by dispersing particles containing a charge transporting substance and a binder resin in liquid medium containing a specific liquid to prepare a dispersion liquid and a process of forming a coat of the dispersion liquid, and heating and drying the coat to dissolve the particles containing the charge transporting substance and the binder resin with liquid medium to form a charge transporting layer.

4 Claims, 2 Drawing Sheets

METHOD OF PRODUCING ELECTROPHOTOGRAPHIC PHOTOSENSITIVE MEMBER

TECHNICAL FIELD

The present invention relates to a method of producing an electrophotographic photosensitive member.

BACKGROUND ART

At present, as electrophotographic photosensitive members for use in a process cartridge and an electrophotographic apparatus, organic electrophotographic photosensitive members (hereinafter also simply referred to as "electrophotographic photosensitive member") containing organic photoconductive substances are mainly used. Among the above, a laminated type (function separation type) electrophotographic photosensitive member whose properties are improved by separating functions required for the electrophotographic photosensitive member in a plurality of layers are mainly used.

As a method of producing the laminated type electrophotographic photosensitive member, a method is generally used which includes dissolving functional materials in an organic solvent to prepare a coating liquid, and then applying the coating liquid onto a support. PTL 1 discloses forming a charge transporting layer using a coating liquid prepared by dissolving constituent materials (a charge transporting substance, a binder resin) of a charge transporting layer in an organic solvent.

CITATION LIST

Patent Literature

PTL 1 Japanese Patent Laid-Open No. 6-123987

SUMMARY OF INVENTION

Technical Problem

However, the use of the liquid prepared by dissolving constituent materials of a charge transporting layer in an organic solvent as a coating liquid as described in PTL 1 has posed a problem such that the concentration and the viscosity of the coating liquid increase due to volatilization of the organic solvent, which makes it difficult to control the film thickness of a coat to be a uniform thickness. In order to maintain the film thickness of the coat to be uniform thickness during production of an electrophotographic photosensitive member, it has been required to frequently adjust the viscosity of the coating liquid or frequently adjust the application speed. Thus, an improvement of workability and an improvement of controllability of the film thickness of the coat have been demanded.

The present invention provides a method of producing an electrophotographic photosensitive member capable of increasing the stability of the viscosity of a coating liquid for the charge transporting layer, which changes with time, to thereby form a charge transporting layer whose film thickness hardly changes.

Solution to Problem

The purpose is achieved by the present invention described below.

The invention relates to a method of producing an electrophotographic photosensitive member having a support and a charge transporting layer formed thereon and the method includes the following processes of: preparing a dispersion liquid containing particles containing a charge transporting substance and a binder resin and liquid medium; forming a coat of the dispersion liquid; heating the coat to dissolve the particles with liquid medium; and drying the coat to form the charge transporting layer; in which liquid medium contains at least one selected from the group consisting of propylene glycol monopropyl ether, propylene glycol-n-butyl ether, 3,3-dimethyl-1-hexanol, ethyl acetyl lactate, 2,2,4-trimethyl-1-pentanol, 2-methyl-2-ethyl-1-pentanol, ethylene glycol monoethyl ether acrylate, butyl formate, phenetole, diethylene glycol dimethyl ether, and methyl propylene glycol acetate.

The invention also relates to a method of producing an electrophotographic photosensitive member having a support and a charge transporting layer formed thereon and the method includes the following processes of: preparing a dispersion liquid containing particles containing a charge transporting substance, particles containing a binder resin, and liquid medium; forming a coat of the dispersion liquid; heating the coat to dissolve the particles containing the charge transporting substance and the particles containing the binder resin with liquid medium; and drying the coat to form the charge transporting layer; in which liquid medium contains at least one selected from the group consisting of propylene glycol monopropyl ether, propylene glycol-n-butyl ether, 3,3-dimethyl-1-hexanol, ethyl acetyl lactate, 2,2,4-trimethyl-1-pentanol, 2-methyl-2-ethyl-1-pentanol, ethylene glycol monoethyl ether acrylate, butyl formate, phenetole, diethylene glycol dimethyl ether, and methyl propylene glycol acetate.

The invention also relates to a method of producing an electrophotographic photosensitive member having a support and a charge transporting layer formed thereon and the method includes the following processes of: preparing a dispersion liquid containing particles containing a charge transporting substance and a binder resin and liquid medium; forming a coat of the dispersion liquid; heating the coat at a temperature at which a difference between the SP value of the charge transporting substance and the SP value of a liquid whose boiling point under one atmospheric pressure is the highest among liquids contained in liquid medium is 6.8 or lower to dissolve the particles with liquid medium; and drying the coat to form the charge transporting layer; in which a difference between the SP value of the charge transporting substance and the SP value of liquid medium at 25° C. under one atmospheric pressure is 7.5 or more.

Advantageous Effects of Invention

The invention can provide a method of producing an electrophotographic photosensitive member capable of increasing the stability of the viscosity of a coating liquid for charge transporting layers, which changes with time, to thereby form a charge transporting layer whose film thickness hardly changes.

DESCRIPTION OF EMBODIMENT

SP Value

Figure 1A:
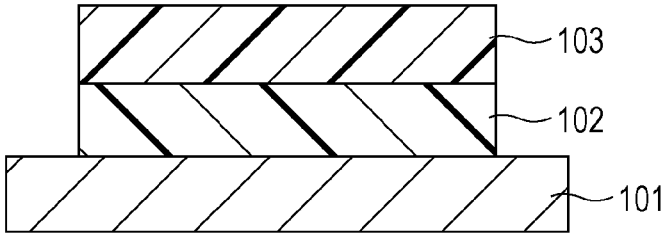
FIGS. 1A and 1B are views illustrating one example of a layer configuration of an electrophotographic photosensitive member.

The invention has a process of preparing a dispersion liquid in which particles containing a charge transporting substance and a binder resin are dispersed in liquid medium and a process of forming a coat of the dispersion liquid, heating the coat to dissolve the particles with liquid medium, and then drying the coat to form a charge transporting layer. Or, the invention has a process of preparing a dispersion liquid in which particles containing a charge transporting substance and particles containing a binder resin are dispersed in liquid medium and a process of forming a coat of the dispersion liquid, heating the coat to dissolve the particles containing the charge transporting substance and the particles containing the binder resin with liquid medium, and then drying the coat to form a charge transporting layer.

In the process of preparing the dispersion liquid, it is suitable to satisfy the conditions such that a difference between the SP value of liquid medium and the SP value of the particles (the particles containing the charge transporting substance and the binder resin or the particles containing the charge transporting substance and the particles containing the binder resin) at 25° C. under one atmospheric pressure is 7.5 or more. By satisfying the conditions, the particles can be dispersed in liquid medium to prepare a dispersion liquid.

The process of forming the coat of the dispersion liquid, and heating and drying the coat to form the charge transporting layer requires forming the coat of the dispersion liquid containing the particles, and then heating the coat to dissolve the particles in liquid medium to allow the particles to adhere to each other. With respect to the heating temperature of the coat of the dispersion liquid, it is suitable to heat the coat at a temperature at which a difference between the value at the heating temperature of the charge transporting substance and the SP value at the heating temperature of a liquid whose boiling point under one atmospheric pressure is the highest among liquids contained in liquid medium is 6.8 or lower. By satisfying the conditions, the particles can be dissolved with liquid medium by heating the coat at the heating temperature, and then the coat can be dried, so that the charge transporting layer can be formed.

Liquids constituting the liquid media described above suitably contain, specifically, at least one selected from the group consisting of propylene glycol monopropyl ether, propylene glycol-n-butyl ether, 3,3-dimethyl-1-hexanol, ethyl acetyl lactate, 2,2,4-trimethyl-1-pentanol, 2-methyl-2-ethyl-1-pentanol, ethylene glycol monoethyl ether acrylate, butyl formate, phenetole, diethylene glycol dimethyl ether, and methyl propylene glycol acetate. When liquid medium is used, in the process of preparing the dispersion liquid, the dissolution of the charge transporting substance or the binder resin is suppressed, the stability of the viscosity of the dispersion liquid increases, and the charge transporting substance and the binder resin are dissolved with liquid medium at a temperature when drying the coat of the dispersion liquid by heating, so that the charge transporting layer whose film thickness hardly changes can be formed.

The SP value is described. The SP value refers to solubility parameters. The SP value is a value which serves as an index of the affinity of two or more kinds of substances and is represented by the square root of the molecule cohesive energy. For the SP value in the invention, a technique of Hansen is used. The technique of Hansen is one in which the energy of one substance is expressed by three components of a dispersion energy term (δD), a polarization energy term (δP), and a hydrogen bond energy term (δH) and expressed as a vector in a three-dimensional space. A case where a difference in the SP value between two kinds of substances is small (the distance between two kinds of substances is short) shows that the two kinds of substances have high solubility. Similarly, a case where a difference in the SP value between two kinds of substances is large (the distance between the two kinds of substances is large) shows that the two kinds of substances have low solubility.

The values of δD, δP, and δH of each substance is disclosed in Hansen Solubility Parameters: A User's Handbook second edition, CRC Press, 2007. The values can also be calculated by the use of a commercially-available software, such as Molucular Modeling Pro of Chemistry-Softwear or SLOPE of Dynacomp, Inc. In the invention, the numerical values are calculated using Calculation soft HSPiP with a database, 3rd Edition 3.1.14 developed and marketed by the group of Mr. Hansen. The charge transporting substance, liquid medium, and the liquids in liquid medium are determined for δD (dispersion term), δP (polarization term), and δH (hydrogen bond term) using the software, and then the SP values $(J/cm^3)^{1/2}$ were calculated by the following expression (4). SQRT indicates the square root.

$$\text{SP value}=\text{SQRT}(\delta D^2+\delta P^2+\delta H^2) \qquad \text{Expression (4)}$$

The difference in the calculated SP values of two kinds of substances can be used as an index of the affinity of the two kinds of substances. Thus, the difference between the SP value of liquid medium and the SP value of the charge transporting substance can be used as an index of solubility. In order to stably maintain the state of the dispersion liquid, it is necessary to reduce the solubility of the two kinds of substances. As the SP value, the difference between the SP value of the charge transporting substance and the SP value of liquid medium at 25° C. under one atmospheric pressure is suitably 7.5 or more.

Expression (5) which expresses the difference between the SP value of liquid medium and the SP value of the charge transporting substance at 25° C. under one atmospheric pressure is shown below.

(Difference of SP value of Liquid medium and SP value of Charge transporting substance at 25° C. under one atmospheric pressure)=|(SP value of Liquid medium at 25° C. under one atmospheric pressure)−|(SP value of Charge transporting substance at 25° C. under one atmospheric pressure)| Expression (5)

When liquid medium is a mixed liquid containing a plurality of liquids, δD, δP, and δH of each liquid are determined, and then the SP value as a mixture is determined to be used as the SP value of liquid medium. An example of the case where liquid medium is a mixed liquid containing a plurality of liquids is given. As the mixed Hansen SP value when mixing a first liquid, a second liquid, and a third liquid with a volume ratio of a:b:c, the SP value as a mixture can be determined using the following expressions (7) to (10).

$$\delta D_{mix}=(a\times\delta D_1+b\times\delta D_2+c\times\delta D_3)/(a+b+c) \qquad \text{Expression (7)}$$

$$\delta P_{mix}=(a\times\delta P_1+b\times\delta P_2+c\times\delta P_3)/(a+b+c) \qquad \text{Expression (8)}$$

$$\delta H_{mix}=(a\times\delta H_1+b\times\delta H_2+c\times\delta H_3)/(a+b+c) \qquad \text{Expression (9)}$$

$$\text{SP value}=\text{SQRT}(\delta D_{mix}^2+\delta P_{mix}^2+\delta H_{mix}^2) \qquad \text{Expression (10)}$$

In the invention, the coat of the dispersion liquid in which the particles containing the charge transporting substance and the binder resin are dispersed in liquid medium or the dispersion liquid in which the particles containing the charge transporting substance and the particles containing the binder resin are dispersed in liquid medium is formed. Next, it is suitable to have a process of forming the charge transporting layer by heating the coat at a temperature at which the difference between the SP value of the charge transporting substance and the SP value of a liquid whose boiling point under one atmospheric pressure is the highest among liquids contained in liquid medium is 6.8 or lower. This process is a process of heating the coat of the dispersion liquid to thereby dissolve the charge transporting substance in the heated liquid medium or the liquid in liquid medium. In this process, the binder resin dissolves in the liquid in which the charge transporting substance dissolves by heating.

It is considered that, by heating the coat at a temperature satisfying the conditions of the process, the particles dissolve in the liquid in liquid medium, and by drying the same, a uniform film is formed. Thus, the difference between the SP value of the charge transporting substance in the particles and the SP value of liquid medium at the heating temperature can be used as an index of solubility. Furthermore, since liquid medium is gradually evaporated at the heating temperature and removed, the liquid in liquid medium which finally dissolves the charge transporting substance or the binder resin is a liquid whose boiling point is the highest under one atmospheric pressure. As described above, the difference between the SP value at the heating temperature of the liquid whose boiling point under one atmospheric pressure is the highest among liquids contained in liquid medium and the SP value at the heating temperature of the charge transporting substance can be used as an index of solubility.

Expression (11) which expresses the difference at a heating temperature T (° C.) between the SP value at the temperature T of a liquid whose boiling point is the highest under one atmospheric pressure among liquids contained in liquid medium and the SP value at the temperature T of the charge transporting substance below is shown below.

(Difference in SP value at $T$(° C.))=|SP value at $T$(° C.) of a liquid whose boiling point is the highest under one atmospheric pressure among liquids contained in liquid medium)−(SP value at $T$(° C.) of charge transporting substance)| Expression (11)

The SP value at the heating temperature T (° C.) is determined as follows. It is known that, with respect to the values of δD(dδD/dT), δP(dδP/dT), and δH(dδH/dT), the SP value at a specific temperature can be calculated according to the following Expressions (12) to (14). In the following Expressions, α indicates a thermal expansion coefficient, which can be calculated by the following expression (15).

$$d\delta D/dT=-1.25\alpha\times\delta D \quad \text{Expression (12)}$$

$$d\delta P/dT=-\alpha/2\times\delta P \quad \text{Expression (13)}$$

$$d\delta H/dT=-\delta H(1.22\times10^{-3}+\alpha/2) \quad \text{Expression (14)}$$

$$\alpha=a\times(1-T\text{ref}/Tc)^{m} \quad \text{Expression (15)}$$

In Expression (15), a and m indicate the constant of each substance, Tc indicates the critical temperature (K), and Tref indicates a temperature (K) to be determined. In the invention, the values of a, m, and Tc were obtained by the calculation software "HSPiP" mentioned above. Tref is the temperature (K) at T (° C.).

The SP value at the heating temperature of the liquid whose boiling point is the highest among the liquids contained in liquid medium and the SP value at the heating temperature of the charge transporting substance are calculated according to Expression (4) using δD, δP, and δH calculated using Expressions (12) to (14). The calculated SP values were substituted in Expression (11), and then the difference at T (° C.) between the SP value at the heating temperature of the liquid whose boiling point is the highest among the liquids contained in liquid medium and the SP value at the heating temperature of the charge transporting substance is obtained.

It is considered in the case of using a plurality of kinds of charge transporting substances in combination that when all the kinds of charge transporting substances each satisfy Expression (11), Expression (11) is satisfied also in the case of combining the plurality of charge transporting substances.

The production method of the invention is a method of producing an electrophotographic photosensitive member having a charge transporting layer. The electrophotographic photosensitive member is suitably a laminated type (function separation type) photosensitive layer having a charge generating layer containing a charge generating substance and a charge transporting layer containing a charge transporting substance. The laminated type photosensitive layer may be a normal layer type photosensitive layer in which the charge generating layer and the charge transporting layer are laminated in the stated order from the support side or may be a reverse layer type photosensitive layer in which the charge transporting layer and the charge generating layer are laminated in the stated order from the support side. From the viewpoint of the electrophotographic characteristics, the normal layer type photosensitive layer is suitable.

Figure 1B:
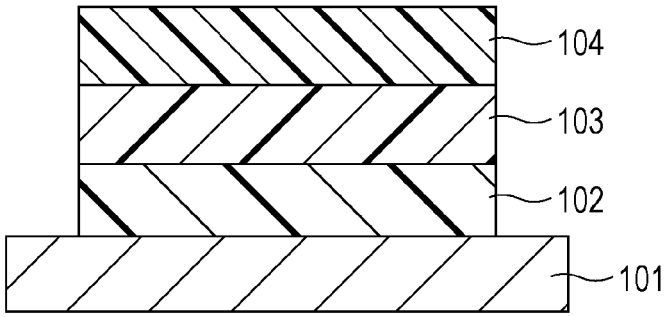

FIGS. 1 and 1B are views illustrating one example of the layer configuration of the electrophotographic photosensitive member of the invention. In FIGS. 1A and 1B, 101 denotes a support, 102 denotes a charge generating layer, 103 denotes a charge transporting layer, and 104 denotes a protective layer (second charge transporting layer). An undercoat layer may be provided between the support 101 and the charge generating layer 102 as required.

The production method and the materials constituting the electrophotographic photosensitive member of the invention are described below.

The charge transporting substance and the binder resin for use in the charge transporting layer are described.

The charge transporting substance for use in the charge transporting layer is suitably a substance having hole transportation ability (hole transporting substance). For example, a triarylamine compound or a hydrazone compound is mentioned. Among the above, the use of the triarylamine compound is suitable in terms of an improvement of the electrophotographic characteristics.

Specific examples of the charge transporting substance are shown below.

[Chem. 1]
(1-1)
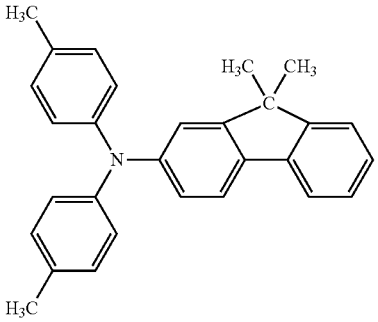
(1-2)
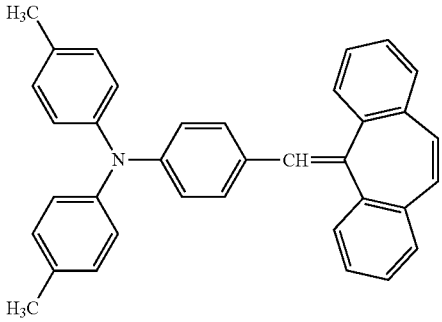
(1-3)
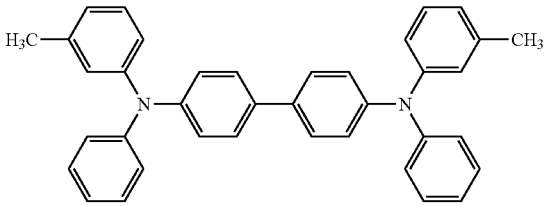
(1-4)
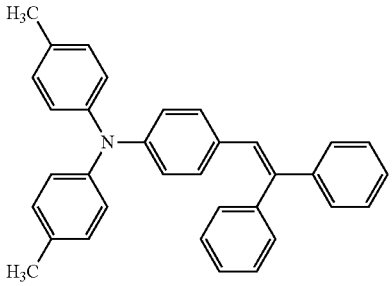
(1-5)
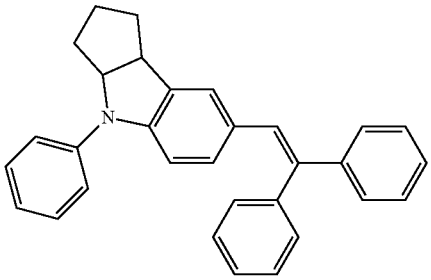
(1-6)
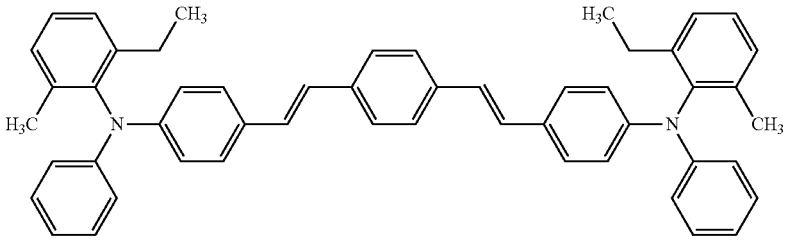
(1-7)
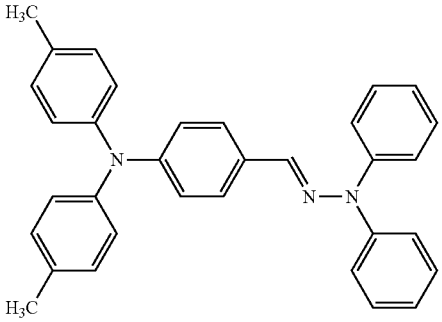

-continued
(1-8)
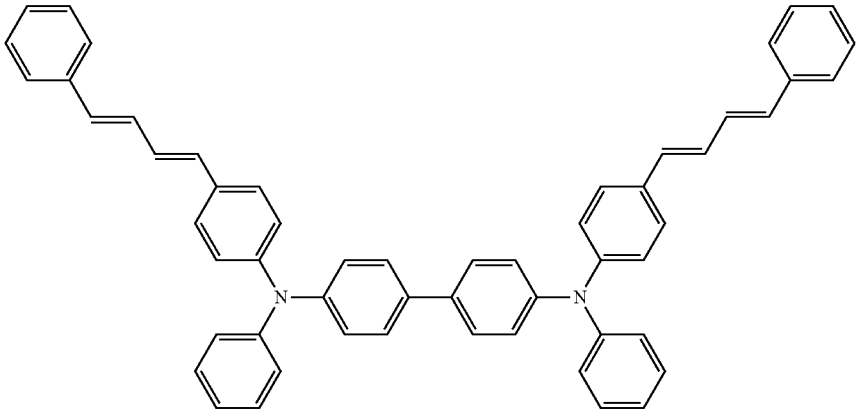
(1-9)
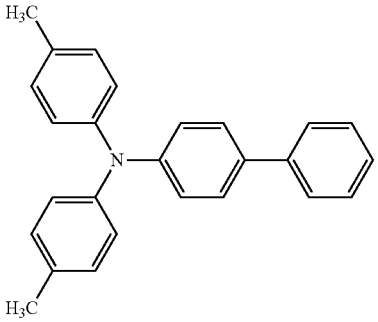
(1-10)
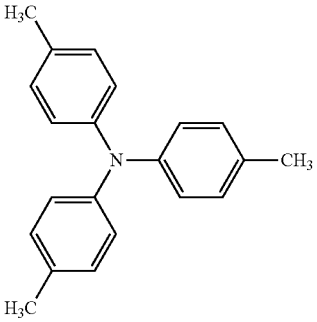
(1-11)
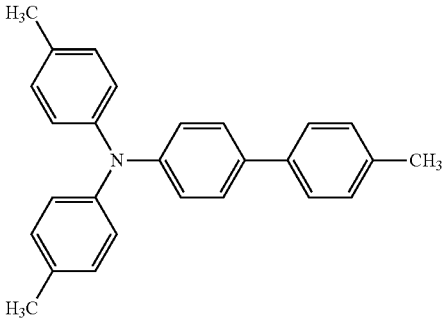
(1-12)
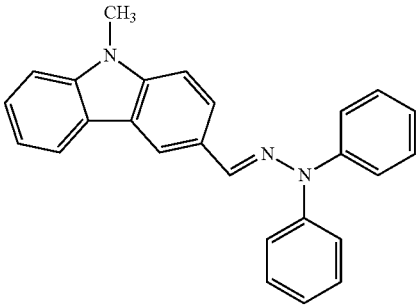
(1-13)
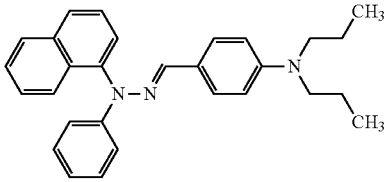
(1-14)
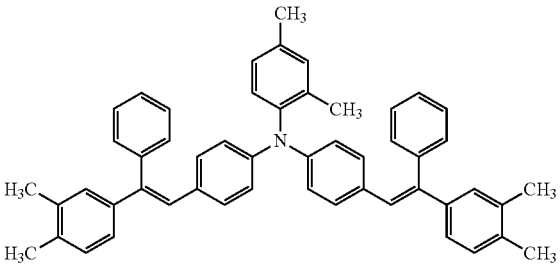

-continued (1-15)

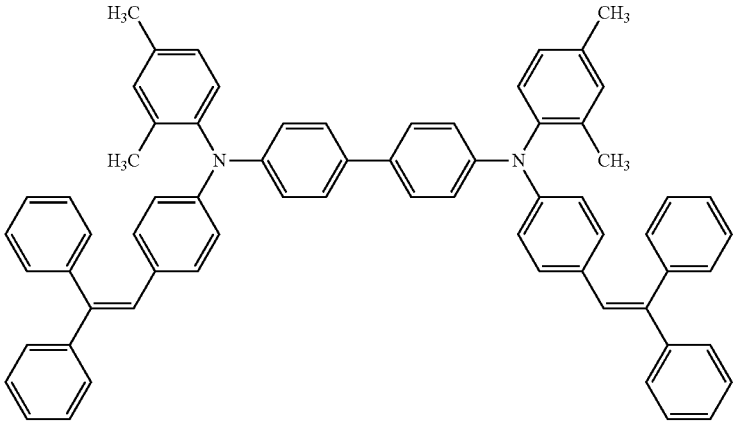

Only one kind or two or more kinds of the charge transporting substances shown above may be used. A suitable range of the SP value of the charge transporting substance at 25° C. under one atmospheric pressure is 20.5 or more and 23.5 or lower.

As the binder resin for use in the charge transporting layer, polystyrene resin, polyacrylic resin, polymethacrylic resin, polycarbonate resin, polyester resin, and the like are mentioned, for example. Among the above, the binder resin is suitably a polycarbonate resin or a polyester resin. The binder resin is suitably a polycarbonate resin having a repeating structural unit represented by the following formula (2) or a polyester resin having a repeating structural unit represented by the following formula (3).

[Chem. 2]

(2)

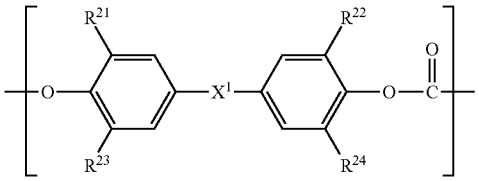

In Formula (2), $R^{21}$ to $R^{24}$ each independently represent a hydrogen atom or a methyl group. $X^1$ represents a single bond, a methylene group, an ethylidene group, a propylidene group, a phenylethylidene group, a cyclohexylidene group, or an oxygen atom.

[Chem. 3]

(3)

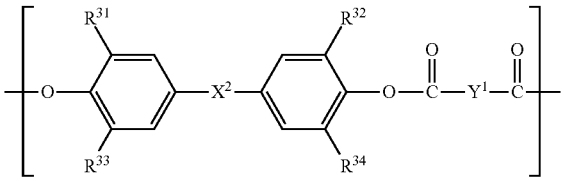

In Formula (3), $R^{31}$ to $R^{34}$ each independently represent a hydrogen atom or a methyl group. $X^2$ represents a single bond, a methylene group, an ethylidene group, a propylidene group, a phenylethylidene group, a cyclohexylidene group, or an oxygen atom. $Y^1$ represents a m-phenylene group, a p-phenylene group, or a divalent group in which two p-phenylene groups are bonded through an oxygen atom.

Specific examples of the repeating structural unit represented by Formula (2) are shown below.

[Chem. 4]

(2-1)

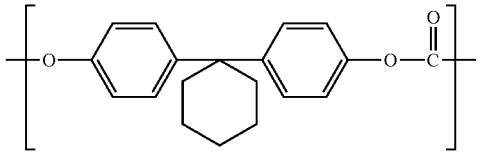

(2-2)

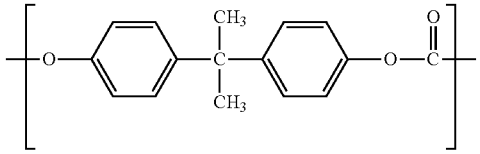

(2-3)

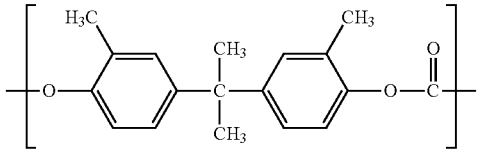

(2-4)

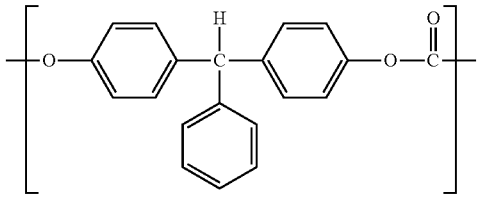

(2-5)

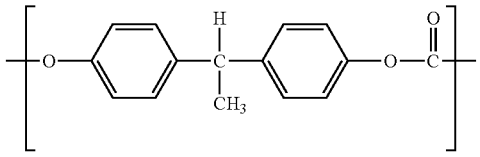

-continued (2-6)

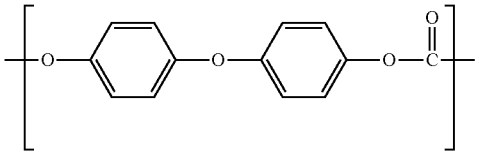

(2-7)

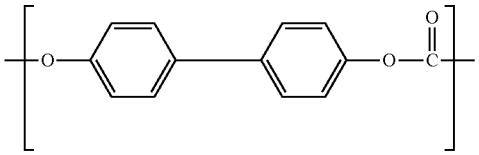

(2-8)

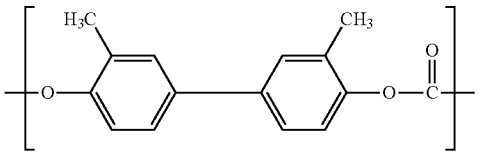

Specific examples of the repeating structural unit represented by Formula (3) are shown below.

[Chem. 5]

(3-1)

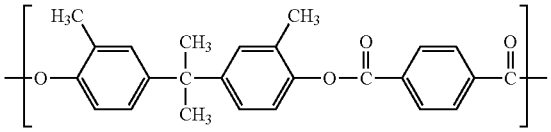

(3-2)

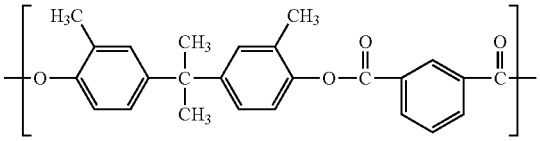

(3-3)

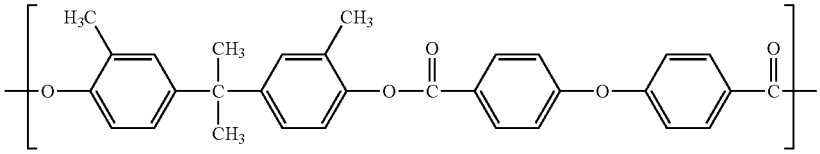

(3-4)

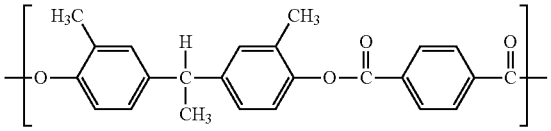

(3-5)

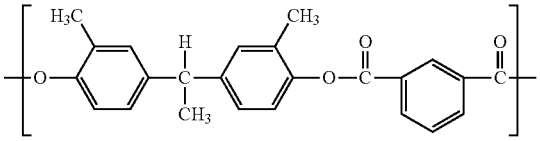

(3-6)

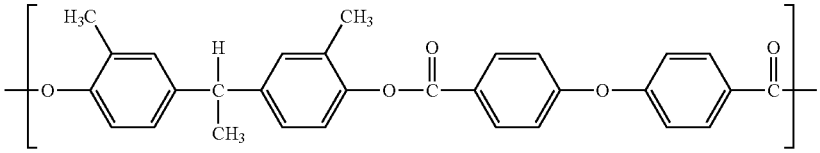

One kind or two or more kinds of the polycarbonate resin and the polyester resin having the repeating structural units can be used alone or as a mixture or a copolymer. The mode of copolymerization may be any mode of block copolymerization, random copolymerization, and alternating copolymerization.

The weight average molecular weight of the binder resin is the weight average molecular weight in terms of polystyrene measured according to a normal method and, specifically, is the weight average molecular weight in terms of polystyrene measured by a method described in Japanese Patent Laid-Open No. 2007-79555.

The particles containing the charge transporting substance and the binder resin are particles at least containing the charge transporting substance and the binder resin in the same particle. A plurality of kinds of charge transporting substances may also be contained in the same particle and a plurality of kinds of binder resins may also be contained in the same particle. As the particles containing the charge transporting substance and the binder resin, particles containing different kinds of charge transporting substances and particles containing different kinds of binder resins may be mixed for use.

The particles containing the charge transporting substance and the particles containing the binder resin are particles at least containing the charge transporting substance in the same particle and particles at least containing the binder resin in the same particle. A plurality of kinds of charge transporting substances may also be contained in the same particle and a plurality of kinds of binder resins may also be contained in the same particle. Particles containing different kinds of charge transporting substances and particles containing different kinds of binder resins may be mixed for use.

The particles containing the charge transporting substance and the binder resin, the particles containing the charge transporting substance, and the particles containing the binder resin may contain additives in addition to the charge transporting substance and the binder resin. Mentioned as the additives are, for example, deterioration preventing agents, such as an antioxidant, an ultraviolet absorber, and a light resistant stabilizer, resin giving mold releasability, and the like. Mentioned as the deterioration preventing agents are, for example, a hindered phenolic antioxidant, a hindered amine-based light resistant stabilizer, a sulfur atom-containing antioxidant, and a phosphorus atom-containing antioxidant. Mentioned as the resin giving mold releasability are, for example, fluorine atom-containing resin and resin having a siloxane structure.

As methods of producing the particles containing the charge transporting substance and the binder resin, the particles containing the charge transporting substance, and the particles containing the binder resin, existing particle production methods can be used. A grinding method and a spray drying method are described below as specific particle producing methods but the invention is not limited to the methods.

As the grinding method, methods, such as dry grinding, wet grinding, and freeze grinding, are mentioned and a grinding method can be selected according to the material and the type of the charge transporting substance, the binder resin, or the additives that are the materials from which particles are produced. As a grinder, a grinder suitable for grinding of flexible materials, elastic materials, or resin based materials is suitable. For example, an ultracentrifugal grinder, a rotor beater mill, a grind mix, and a mixer mill are mentioned. When producing the particles of each material constituting the charge transporting layer using these grinders, particles are produced using a grinder suitable for the materials. When producing particles containing a charge transporting substance and a binding substance or when producing particles containing a plurality of kinds of materials constituting the charge transporting layer in the same particle, the particles are produced by performing mixing treatment, such as kneading, before processing the target constituent materials with a grinder.

The spray drying method is a method referred to as spray dry or spray drying and is excellent in that particles having high uniformity can be produced. The method includes spraying a material dissolving or dispersing in a solvent or a dispersion medium, producing particles while removing the solvent or the dispersion medium, and then collecting the same by a cyclone.

The case is described where the particles containing the charge transporting substance and the binder resin, the particles containing the charge transporting substance, and the particles containing the binder resin in the invention are produced by the spray drying method.

When producing the particles containing the charge transporting substance and the binder resin, the charge transporting substance and the materials constituting the charge transporting layer are dissolved in a solvent capable of dissolving them to thereby prepare a solution. As the concentration of the solution, the solid content concentration of 1 to 10% by mass is suitable in that particles having high uniformity are obtained in the stage of producing the particles. The solution is sprayed and dried using a spray dry device, thereby producing the particles containing the charge transporting substance and the binder resin. The particle diameter is suitably 2 to 15 μm in terms of film thickness uniformity during film formation.

When producing the particles containing the charge transporting substance, the charge transporting substance is dissolved in a solvent capable of dissolving the charge transporting substance to thereby prepare a solution containing the charge transporting substance. As the concentration of the solution, the solid content concentration of 2 to 15% by mass is suitable in that particles can be produced in such a manner as to achieve a small diameter and have good uniformity. The solution is sprayed and dried using a spray dry device, thereby producing the particles containing the charge transporting substance. The particle diameter is suitably 2 to 15 μm in terms of film thickness uniformity during film formation. The particles containing the binder resin are produced by a similar method. Also for the binder resin, a solution containing the binder resin is prepared. As the concentration of the solution, the solid content concentration of 1 to 10% by mass is suitable in that particles having high uniformity are obtained in the stage of producing the particles. The solution is sprayed and dried using a spray dry device, thereby producing the particles containing the binder resin. The particle diameter is suitably 2 to 15 μm in terms of film thickness uniformity during film formation.

Next, the dispersion liquid in which the particles containing the charge transporting substance and the binder resin are dispersed in liquid medium is described. The dispersion liquid is a dispersion liquid in which the particles are dispersed in liquid medium in such a manner as not to cause aggregation or sedimentation under normal temperature (range specified by JIS Z 8703) and under an atmospheric pressure environment. It is suitable for liquid medium for use in the dispersion liquid and the charge transporting substance contained in the particles to satisfy the conditions such that the difference between the SP value of liquid medium and the SP value of the charge transporting substance contained in the particles at 25° C. under one atmospheric pressure is suitably 7.5 or more.

The dispersion liquid in which the particles containing the charge transporting substance and the particles containing the binder resin are dispersed in liquid medium is described. The dispersion liquid is a dispersion liquid in which the particles are dispersed in liquid medium in such a manner as not to cause aggregation or sedimentation at normal temperature (range specified by JIS Z 8703) under an atmospheric pressure environment. It is suitable for liquid medium for use in the dispersion liquid and the charge transporting substance contained in the particles to satisfy the conditions such that the difference between the SP value of liquid medium and the SP value of the charge transporting substance contained in the particles at 25° C. under one atmospheric pressure is suitably 7.5 or more.

In the dispersion liquid in which the particles containing the charge transporting substance are dispersed in liquid medium, the dissolution of the particles is difficult to occur. Thus, the stability of the viscosity of the coating liquid for charge transporting layer which changes with time improves, and even when the dispersion liquid is allowed to stand still for 10 minutes, the aggregation and sedimentation of the particles are difficult to occur.

The dispersion liquid may contain a surfactant. Among surfactants, nonionic surfactants are suitable from the viewpoint of maintaining the electrophotographic characteristics. The nonionic surfactant is one whose hydrophilic portion is a non-electrolytic portion, i.e., having a hydrophilic portion which is not ionized. The content of the surfactant is suitably 9% by mass or lower based on the mass of the particles containing the charge transporting substance and the binder resin or the particles containing the charge transporting substance and the particles containing the binder resin in the dispersion liquid.

The dispersion liquid of the invention may contain additives, such as a surface adjustment agent, an antifoaming agent, and a rheology adjustment agent, in a range where the effects of the invention are not impaired.

Next, a method of preparing the dispersion liquid in which the particles containing the charge transporting substance and the binder resin are dispersed in liquid medium or the dispersion liquid in which the particles containing the charge transporting substance and the particles containing the binder resin are dispersed in liquid medium is described.

As a dispersion method of preparing the dispersion liquid, existing dispersion methods can be used. As specific dispersion methods of the particles, a stirring method and a high-pressure collision method are described below but the invention is not limited thereto.

The stirring method is described. This method includes mixing the particles containing the charge transporting substance and the binder resin with liquid medium, and then stirring the mixture by a stirrer to thereby prepare the dispersion liquid. The stirrer is suitably a stirrer which can perform high-speed stirring in that the mixture can be uniformly dispersed in a short time. As the stirrer, a homogenizer manufactured by Microtec Co., Ltd. (Physcotron), a circulation type homogenizer manufactured by M Technique (Clearmix), and the like are mentioned. Similarly, the dispersion liquid can be prepared using the particles containing the charge transporting substance, the particles containing the binder resin, and liquid medium.

Next, the high-speed collision method is described. This method includes mixing the particles containing the charge transporting substance and the binder resin and liquid medium, and then allowing the mixed liquid to collide under high pressure to thereby prepare the dispersion liquid. As a high-pressure collision apparatus, Microfluidizer M-110EH manufactured by U.S. Microliquidics, Nanomiser YSNM-2000AR manufactured by Yoshida kikai co., Ltd., and the like are mentioned. Similarly, the dispersion liquid containing the particles containing the charge transporting substance, the particles containing binder resin, and liquid medium can also be prepared.

Next, the concentration and the mixing ratio of the particles in the dispersion liquid are described. The total of the mass of the particles containing the charge transporting substance and the particles containing the binder resin in the dispersion liquid is suitably 5 to 40% by mass based on the total mass of the dispersion liquid. The ratio of the particles containing the charge transporting substance and the particles containing the binder resin is suitably in the range of 4:10 to 20:10 (mass ratio) and more suitably in the range of 5:10 to 12:10 (mass ratio).

The mass of the particles containing the charge transporting substance and the binder resin in the dispersion liquid is suitably 5 to 40% by mass based on the total mass of the dispersion liquid. The ratio of the charge transporting substance and the binder resin in the particles containing the charge transporting substance and the binder resin is suitably in the range of 4:10 to 20:10 (mass ratio) and more suitably in the range of 5:10 to 12:10 (mass ratio).

Next, liquid medium in the invention is described. Liquid medium for use in the dispersion liquid containing the particles containing the charge transporting substance and the binder resin is suitably a liquid in which a difference between the SP value of the charge transporting substance contained in the particles and the SP value of a liquid whose boiling point under one atmospheric pressure is the highest among liquids contained in liquid medium is 6.8 or lower at a temperature of heating a coat of the dispersion liquid described later. As described above, in liquid medium, the difference between the SP value of liquid medium and the SP value of the charge transporting substance contained in the particles at 25° C. under one atmospheric pressure is suitably 7.5 or more.

Liquid medium for use in the dispersion liquid containing the particles containing the charge transporting substance and the particles containing the binder resin is suitably a liquid in which the difference between the SP value of the charge transporting substance contained in the particles and the SP value of a liquid whose boiling point under one atmospheric pressure is the highest among liquids contained in liquid medium is 6.8 or lower at a temperature of heating a coat of the dispersion liquid described later. As described above, in liquid medium, the difference between the SP value of liquid medium and the SP value of the charge transporting substance contained in the particles at 25° C. under one atmospheric pressure is suitably 7.5 or more.

A process of forming a coat of the dispersion liquid, and then heating the coat to thereby form the charge transporting layer is described.

After forming the coat of the dispersion liquid containing the particles containing the charge transporting substance and the binder resin, it is necessary to heat the coat to allow the particles to adhere to each other. After forming the coat of the dispersion liquid containing the particles containing the charge transporting substance and the particles containing the binder resin, it is necessary to heat the coat to let the particles to adhere to each other. With respect to the heating temperature of the coat of the dispersion liquid, the coat is suitably heated at a temperature at which the difference between the SP value of the charge transporting substance at the heating temperature and the SP value of a liquid whose boiling point under one atmospheric pressure is the highest among liquids contained in liquid medium is 6.8 or lower. The use of the dispersion liquid allows the formation of a charge transporting layer in which the viscosity change with time can be reduced and the film thickness hardly changes because the dissolution level of the charge transporting substance or the binder resin is low even when liquid medium is evaporated as compared with a solution. By heating at a temperature at which the difference from the SP value of a liquid whose boiling point is the highest is 6.8 or lower, the particles containing the charge transporting substance dissolves in the liquid whose boiling point is the highest in liquid medium in the coat, whereby the charge transporting layer can be formed.

A suitable liquid capable of satisfying the SP value of the invention described above is at least one liquid selected from the group consisting of propylene glycol monopropyl ether (Boiling point of 150° C.), propylene glycol-n-butyl ether (Boiling point of 171° C.), 3,3-dimethyl-1-hexanol (Boiling point of 178° C.), ethyl acetyl lactate (Boiling point of 186° C.), 2,2,4-trimethyl-1-pentanol (Boiling point of 167° C.), 2-methyl-2-ethyl-1-pentanol (Boiling point of 179° C.), ethylene glycol monoethyl ether acrylate (Boiling point of 184° C.), butyl formate (Boiling point of 107° C.), phenetole (Boiling point of 173° C.), diethylene glycol dimethyl ether (Boiling point of 170° C.), and methyl propylene glycol acetate (Boiling point of 146° C.) Due to the fact that these liquids are contained, the stability of the dispersion liquid improves at 25° C. under one atmospheric pressure and the solubility of the charge transporting substance improves at the heating temperature when drying the coat by heating. Thus, the stability of the viscosity of the coating liquid for charge transporting layer can be further increased, so that the charge transporting layer whose film thickness hardly changes can be formed.

In the invention, liquid medium suitably contains at least one selected from the group consisting of propylene glycol monopropyl ether, propylene glycol-n-butyl ether, 3,3-dimethyl-1-hexanol, ethyl acetyl lactate, 2,2,4-trimethyl-1-pentanol, 2-methyl-2-ethyl-1-pentanol, ethylene glycol monoethyl ether acrylate, butyl formate, phenetole, diethylene glycol dimethyl ether, and methyl propylene glycol acetate.

Liquid medium in the invention suitably contains water. By preparing the dispersion liquid using liquid medium containing water, the concentration change in the dispersion liquid caused by the volatilization of an organic solvent can be further suppressed, and the film thickness change in the charge transporting layer when producing the electrophotographic photosensitive member can be further reduced.

The heating temperature of the coat is suitably 100° C. or higher. The heating temperature of the coat is more suitably 100° C. or higher and 140° C. or lower.

The calculation results of the SP value of the charge transporting substance, the binder resin liquid medium, and the liquid whose boiling point is the highest among the liquids contained in liquid medium at the heating temperature T (° C.) obtained using the method of calculating the SP value described above are shown in Tables 1 to 10.

TABLE 1

| SP value of charge transporting substance at 25° C. under one atmospheric pressure | |
|---|---|
| Charge transporting substance | SP value |
| (1-1) | 21.5 |
| (1-2) | 21.8 |

TABLE 1-continued

| SP value of charge transporting substance at 25° C. under one atmospheric pressure | |
|---|---|
| Charge transporting substance | SP value |
| (1-3) | 21.8 |
| (1-4) | 21.5 |
| (1-5) | 21.7 |
| (1-6) | 21.0 |
| (1-7) | 21.8 |
| (1-8) | 21.6 |
| (1-9) | 21.5 |
| (1-10) | 21.5 |
| (1-11) | 21.9 |
| (1-12) | 23.3 |
| (1-13) | 20.6 |
| (1-14) | 20.5 |
| (1-15) | 21.3 |

TABLE 2

| | Mixing ratio of liquid in liquid medium | SP value |
|---|---|---|
| Liquid medium 1 | Water:PNB = 96:4 | 46.5 |
| Liquid medium 2 | PFG:Water = 56:44 | 30.5 |
| Liquid medium 3 | PFG:Water = 50:50 | 32.3 |
| Liquid medium 4 | PFG:Water = 40:60 | 35.2 |
| Liquid medium 5 | PFG:Water = 20:80 | 41.4 |
| Liquid medium 6 | PFG:Water = 10:90 | 44.6 |
| Liquid medium 7 | Water:PFG:3,3-dimethyl-1-hexanol = 80:19:1 | 41.4 |
| Liquid medium 8 | Water:PFG:Ethyl acetyl lactate = 80:10:10 | 41.4 |
| Liquid medium 9 | Ethyl acetyl lactate:Water = 55:45 | 30.4 |
| Liquid medium 10 | Ethyl acetyl lactate:Water = 20:80 | 41.3 |
| Liquid medium 11 | Ethylene glycol monoethyl ether acrylate:Water = 1:99 | 47.5 |
| Liquid medium 12 | Water:PNB:2,2,4-trimethyl-1-pentanol = 95:4:1 | 46.2 |
| Liquid medium 13 | Water:PFG:3,3-dimethyl-1-hexanol = 90:9:1 | 44.6 |
| Liquid medium 14 | Water:2-methyl2-ethyl1-pentanol:ethylacetyl lactate = 80:1:19 | 41.3 |
| Liquid medium 15 | Water:ethylacetyl lactate:butyl formate = 80:19:1 | 41.3 |
| Liquid medium 16 | Water:ethylacetyl lactate:Ethylene glycol monoethyl ether acrylate = 80:19:1 | 41.3 |
| Liquid medium 17 | Water:PFG:PNB = 60:35:5 | 35.2 |
| Liquid medium 18 | Water:PFG:PNB = 80:15:5 | 41.4 |
| Liquid medium 19 | EtOH:MeOH:Water:Phenetole = 50:24:21:5 | 30.8 |
| Liquid medium 20 | MeOH:EtOH:Water:Phenetole = 36:32:25:7 | 31.7 |
| Liquid medium 21 | EtOH:Water:Phenetole = 65:30:5 | 31.9 |
| Liquid medium 22 | EtOH:WaterChlorobenzene:PNB = 70:25:4:1 | 30.8 |
| Liquid medium 23 | EtOH:Water:Toluene:PFG = 71:25:3:1 | 30.9 |
| Liquid medium 24 | EtOH:Water:Phenetole:THF = 70:25:4:1 | 30.9 |
| Liquid medium 25 | EtOH:Water:Phenetole:DMM = 60:30:5:5 | 31.3 |
| Liquid medium 26 | Water:EtOH:THF:PFG = 60:30:5:5 | 37.9 |
| Liquid medium 27 | EtOH:Water:DMM:Phenetole:DMG = 45:40:5:5:5 | 32.8 |
| Liquid medium 28 | Water:DMDG = 80:20 | 40.1 |
| Liquid medium 29 | EtOH:Water:Dibenzyl ether:DMDG = 68:26:5:1 | 31.0 |
| Liquid medium 30 | EtOH:Water:DMG:MFG-Ac = 63:27:5:5 | 30.9 |
| Liquid medium 31 | EtOH:Water:DMM:DMDG:DMG = 50:38:5:5:2 | 32.8 |
| Liquid medium 32 | EtOH:Water:DMG:PFG = 63:27:5:5 | 30.9 |
| Liquid medium 33 | Water:EtOH:DMDG:THF = 50:43:5:2 | 36.0 |
| Liquid medium 34 | WaterEtOH:MFG-Ac:THF = 50:43:5:2 | 36.1 |

In Table 2, PNB represents propylene glycol-n-butyl ether, PFG represents propylene glycol monopropyl ether, EtOH represents ethanol, MeOH represents methanol, THF represents tetrahydrofuran, DMM represents dimethoxy methane, DMDG represents diethylene glycol dimethyl ether, DMG represents dimethyl glycol, and MFG-Ac represents methyl propylene glycol acetate. Each ratio of Table 2 is a volume ratio.

TABLE 3

| | | Charge transporting substance | | | | | | | | | | | | | | |
|---|---|---|---|---|---|---|---|---|---|---|---|---|---|---|---|---|
| | | (1-1) | (1-2) | (1-3) | (1-4) | (1-5) | (1-6) | (1-7) | (1-8) | (1-9) | (1-10) | (1-11) | (1-12) | (1-13) | (1-14) | (1-15) |
| | | SP Value | | | | | | | | | | | | | | |
| | | 21.5 | 21.8 | 21.8 | 21.5 | 21.7 | 21.0 | 21.8 | 21.6 | 21.5 | 21.5 | 21.9 | 23.3 | 20.6 | 20.5 | 21.3 |
| Liquid medium 1 | 46.5 | 25.0 | 24.7 | 24.7 | 25.0 | 24.8 | 25.5 | 24.7 | 24.9 | 25.0 | 25.0 | 24.6 | 23.2 | 25.9 | 26.0 | 25.2 |
| Liquid medium 2 | 30.5 | 9.0 | 8.7 | 8.7 | 9.0 | 8.8 | 9.5 | 8.7 | 8.9 | 9.0 | 9.0 | 8.6 | 7.2 | 9.9 | 10.0 | 9.2 |
| Liquid medium 3 | 32.3 | 10.8 | 10.5 | 10.4 | 10.8 | 10.5 | 11.2 | 10.5 | 10.7 | 10.7 | 10.8 | 10.4 | 9.0 | 11.6 | 11.8 | 10.9 |
| Liquid medium 4 | 35.2 | 13.8 | 13.5 | 13.4 | 13.8 | 13.5 | 14.2 | 13.5 | 13.7 | 13.7 | 13.8 | 13.4 | 12.0 | 14.6 | 14.8 | 13.9 |
| Liquid medium 5 | 41.4 | 19.9 | 19.6 | 19.6 | 20.0 | 19.7 | 20.4 | 19.7 | 19.8 | 19.9 | 20.0 | 19.5 | 18.2 | 20.8 | 21.0 | 20.1 |
| Liquid medium 6 | 44.6 | 23.1 | 22.8 | 22.8 | 23.1 | 22.9 | 23.6 | 22.8 | 23.0 | 23.1 | 23.1 | 22.7 | 21.3 | 24.0 | 24.1 | 23.3 |
| Liquid medium 7 | 41.4 | 19.9 | 19.6 | 19.6 | 20.0 | 19.7 | 20.4 | 19.7 | 19.8 | 19.9 | 20.0 | 19.5 | 18.2 | 20.8 | 21.0 | 20.1 |
| Liquid medium 8 | 41.4 | 19.9 | 19.6 | 19.5 | 19.9 | 19.6 | 20.3 | 19.6 | 19.8 | 19.8 | 19.9 | 19.5 | 18.1 | 20.8 | 20.9 | 20.0 |
| Liquid medium 9 | 30.4 | 9.0 | 8.7 | 8.6 | 9.0 | 8.7 | 9.4 | 8.7 | 8.9 | 8.9 | 9.0 | 8.5 | 7.2 | 9.8 | 10.0 | 9.1 |
| Liquid medium 10 | 41.3 | 19.8 | 19.5 | 19.5 | 19.8 | 19.6 | 20.3 | 19.5 | 19.7 | 19.8 | 19.8 | 19.4 | 18.0 | 20.7 | 20.8 | 20.0 |
| Liquid medium 11 | 47.5 | 26.0 | 25.7 | 25.7 | 26.0 | 25.8 | 26.4 | 25.7 | 25.9 | 25.9 | 26.0 | 25.6 | 24.2 | 26.9 | 27.0 | 26.1 |
| Liquid medium 12 | 46.2 | 24.7 | 24.4 | 24.3 | 24.7 | 24.4 | 25.1 | 24.4 | 24.6 | 24.6 | 24.7 | 24.3 | 22.9 | 25.5 | 25.7 | 24.8 |
| Liquid medium 13 | 44.6 | 23.1 | 22.8 | 22.8 | 23.1 | 22.9 | 23.6 | 22.8 | 23.0 | 23.1 | 23.1 | 22.7 | 21.3 | 24.0 | 24.1 | 23.2 |
| Liquid medium 14 | 41.3 | 19.8 | 19.5 | 19.5 | 19.8 | 19.6 | 20.3 | 19.5 | 19.7 | 19.8 | 19.8 | 19.4 | 18.0 | 20.7 | 20.8 | 20.0 |
| Liquid medium 15 | 41.3 | 19.8 | 19.5 | 19.5 | 19.8 | 19.6 | 20.3 | 19.5 | 19.7 | 19.8 | 19.8 | 19.4 | 18.0 | 20.7 | 20.8 | 20.0 |
| Liquid medium 16 | 41.3 | 19.8 | 19.5 | 19.5 | 19.8 | 19.6 | 20.3 | 19.5 | 19.7 | 19.8 | 19.8 | 19.4 | 18.0 | 20.7 | 20.8 | 20.0 |
| Liquid medium 17 | 35.2 | 13.7 | 13.4 | 13.4 | 13.7 | 13.5 | 14.2 | 13.4 | 13.6 | 13.7 | 13.7 | 13.3 | 11.9 | 14.6 | 14.7 | 13.9 |
| Liquid medium 18 | 41.4 | 19.9 | 19.6 | 19.6 | 19.9 | 19.7 | 20.4 | 19.6 | 19.8 | 19.9 | 19.9 | 19.5 | 18.1 | 20.8 | 20.9 | 20.1 |
| Liquid medium 19 | 30.8 | 9.3 | 9.0 | 9.0 | 9.3 | 9.1 | 9.8 | 9.0 | 9.2 | 9.3 | 9.3 | 8.9 | 7.5 | 10.2 | 10.3 | 9.5 |
| Liquid medium 20 | 31.7 | 10.2 | 9.9 | 9.9 | 10.2 | 10.0 | 10.7 | 9.9 | 10.1 | 10.2 | 10.2 | 9.8 | 8.4 | 11.1 | 11.2 | 10.4 |
| Liquid medium 21 | 31.9 | 10.4 | 10.1 | 10.1 | 10.4 | 10.2 | 10.9 | 10.1 | 10.3 | 10.4 | 10.4 | 10.0 | 8.6 | 11.3 | 11.4 | 10.6 |
| Liquid medium 22 | 30.8 | 9.3 | 9.0 | 9.0 | 9.3 | 9.1 | 9.8 | 9.0 | 9.2 | 9.3 | 9.3 | 8.9 | 7.5 | 10.2 | 10.3 | 9.5 |
| Liquid medium 23 | 30.9 | 9.4 | 9.1 | 9.1 | 9.4 | 9.2 | 9.9 | 9.1 | 9.3 | 9.4 | 9.4 | 9.0 | 7.6 | 10.3 | 10.4 | 9.6 |
| Liquid medium 24 | 30.9 | 9.4 | 9.1 | 9.1 | 9.4 | 9.2 | 9.9 | 9.1 | 9.3 | 9.4 | 9.4 | 9.0 | 7.6 | 10.3 | 10.4 | 9.6 |
| Liquid medium 25 | 31.3 | 9.8 | 9.5 | 9.5 | 9.8 | 9.6 | 10.3 | 9.5 | 9.7 | 9.8 | 9.8 | 9.4 | 8.0 | 10.7 | 10.8 | 10.0 |
| Liquid medium 26 | 37.9 | 16.4 | 16.1 | 16.1 | 16.4 | 16.2 | 16.9 | 16.1 | 16.3 | 16.4 | 16.4 | 16.0 | 14.6 | 17.3 | 17.4 | 16.6 |
| Liquid medium 27 | 32.8 | 11.3 | 11.0 | 11.0 | 11.3 | 11.1 | 11.8 | 11.0 | 11.2 | 11.3 | 11.3 | 10.9 | 9.5 | 12.2 | 12.3 | 11.5 |
| Liquid medium 28 | 40.1 | 18.6 | 18.3 | 18.3 | 18.6 | 18.4 | 19.1 | 18.3 | 18.5 | 18.6 | 18.6 | 18.2 | 16.8 | 19.5 | 19.6 | 18.8 |
| Liquid medium 29 | 31.0 | 9.5 | 9.2 | 9.2 | 9.5 | 9.3 | 10.0 | 9.2 | 9.4 | 9.5 | 9.5 | 9.1 | 7.7 | 10.4 | 10.5 | 9.7 |
| Liquid medium 30 | 30.9 | 9.4 | 9.1 | 9.1 | 9.4 | 9.2 | 9.9 | 9.1 | 9.3 | 9.4 | 9.4 | 9.0 | 7.6 | 10.3 | 10.4 | 9.6 |
| Liquid medium 31 | 32.8 | 11.3 | 11.0 | 11.0 | 11.3 | 11.1 | 11.8 | 11.0 | 11.2 | 11.3 | 11.3 | 10.9 | 9.5 | 12.2 | 12.3 | 11.5 |
| Liquid medium 32 | 30.9 | 9.4 | 9.1 | 9.1 | 9.4 | 9.2 | 9.9 | 9.1 | 9.3 | 9.4 | 9.4 | 9.0 | 7.6 | 10.3 | 10.4 | 9.6 |
| Liquid medium 33 | 36.0 | 14.5 | 14.2 | 14.2 | 14.5 | 14.3 | 15.0 | 14.2 | 14.4 | 14.5 | 14.5 | 14.1 | 12.7 | 15.4 | 15.5 | 14.7 |
| Liquid medium 34 | 36.1 | 14.6 | 14.3 | 14.3 | 14.6 | 14.4 | 15.1 | 14.3 | 14.5 | 14.6 | 14.6 | 14.2 | 12.8 | 15.5 | 15.6 | 14.8 |

TABLE 4

| SP Value at heating temperature T(° C.) of charge transporting substance | | | | | |
|---|---|---|---|---|---|
| Charge transporting substance | Heating temperature(° C.) | | | | |
| | 100° C. | 110° C. | 120° C. | 130° C. | 140° C. |
| (1-1) | 20.9 | 20.8 | 20.7 | 20.7 | 20.6 |
| (1-2) | 19.7 | 19.5 | 19.2 | 18.9 | 18.7 |
| (1-3) | 21.3 | 21.2 | 21.1 | 21.1 | 20.9 |
| (1-4) | 20.8 | 20.7 | 20.6 | 20.5 | 20.4 |
| (1-5) | 19.9 | 19.6 | 19.4 | 19.1 | 18.8 |
| (1-6) | 20.2 | 20.1 | 19.9 | 19.8 | 19.7 |
| (1-7) | 21.1 | 21.0 | 20.9 | 20.8 | 20.7 |
| (1-8) | 20.7 | 20.6 | 20.5 | 20.4 | 20.3 |

TABLE 4-continued

| SP Value at heating temperature T(° C.) of charge transporting substance | | | | | |
|---|---|---|---|---|---|
| Charge transporting substance | Heating temperature(° C.) | | | | |
| | 100° C. | 110° C. | 120° C. | 130° C. | 140° C. |
| (1-9) | 20.7 | 20.6 | 20.5 | 20.3 | 20.2 |
| (1-10) | 20.6 | 20.5 | 20.4 | 20.3 | 20.1 |
| (1-11) | 21.1 | 20.9 | 20.8 | 20.7 | 20.6 |
| (1-12) | 21.2 | 21.0 | 20.7 | 20.3 | 20.0 |
| (1-13) | 19.8 | 19.7 | 19.6 | 19.5 | 19.4 |
| (1-14) | 18.8 | 18.6 | 18.3 | 18.1 | 17.8 |
| (1-15) | 19.5 | 19.2 | 18.9 | 18.6 | 18.4 |

TABLE 5

| SP Value of liquid contained in liquid medium at heating temperature T(° C.) | | | | | |
|---|---|---|---|---|---|
| | Heating temperature(° C.) | | | | |
| Liquids contained in liquid medium | 100° C. | 110° C. | 120° C. | 130° C. | 140° C. |
| PNB | 15.7 | 15.3 | 14.8 | 14.3 | 13.7 |
| PFG | 15.7 | 15.0 | 14.3 | 13.5 | 12.8 |
| 2,2,4-trimethyl1-pentanol | 16.6 | 16.4 | 16.1 | 15.7 | 15.5 |
| 3,3-dimethyl1-hexanol | 17.7 | 16.5 | 17.5 | 17.3 | 17.2 |
| 2-methyl2-ethyl1-pentanol | 17.0 | 16.8 | 16.5 | 16.2 | 15.9 |
| Ethylacetyl lactate | 17.0 | 16.7 | 16.5 | 16.1 | 15.8 |
| Ethylene glycol monoethyl ether acrylate | 16.9 | 16.5 | 16.1 | 15.8 | 15.3 |

TABLE 5-continued

| SP Value of liquid contained in liquid medium at heating temperature T(° C.) | | | | | |
|---|---|---|---|---|---|
| | Heating temperature(° C.) | | | | |
| Liquids contained in liquid medium | 100° C. | 110° C. | 120° C. | 130° C. | 140° C. |
| Butyl formate | 17.1 | >b.p. | >b.p. | >b.p. | >b.p. |
| Phenetole | 17.5 | 17.3 | 17.0 | 16.7 | 16.4 |
| Dibenzyl ether | 19.1 | 18.8 | 18.6 | 18.3 | 18.1 |
| DMDG | 16.1 | 15.9 | 15.5 | 15.2 | 14.9 |
| MFG-Ac | 16.8 | 16.3 | 15.8 | 15.4 | 14.9 |

In Table 5, PNB represents propylene glycol-n-butyl ether, PFG represents propylene glycol monopropyl ether, DMDG represents diethylene glycol dimethyl ether, and MFG-Ac represents methyl propylene glycol acetate. >b.p. in Table 5 represents that the heating temperature is a temperature equal to or higher than the boiling point of the corresponding liquid.

TABLE 6

| Difference in SP Value of charge transporting substance and SP Value of liquids contained in liquid medium at heating temperature of 100° C. | | | | | | | | | |
|---|---|---|---|---|---|---|---|---|---|
| | | Liquids contained in liquid medium | | | | | | | |
| Charge transporting substance | SP Value | PNB 15.7 | PFG 15.7 | 2,2,4-trimethyl1-pentanol 16.6 | 3,3-dimethyl1-hexanol 17.7 | 2-methyl2-ethyl1-pentanol 17 | Ethylacetyl lactate 17 | Ethylene glycol monoethyl ether acrylate 16.9 | Butyl formate 17.1 |
| (1-1) | 20.9 | 5.2 | 5.3 | 4.4 | 3.2 | 3.9 | 3.9 | 4.1 | 3.9 |
| (1-2) | 19.7 | 4 | 4.1 | 3.2 | 2 | 2.7 | 2.7 | 2.9 | 2.7 |
| (1-3) | 21.3 | 5.6 | 5.6 | 4.7 | 3.6 | 4.2 | 4.3 | 4.4 | 4.2 |
| (1-4) | 20.8 | 5.1 | 5.1 | 4.2 | 3.1 | 3.8 | 3.8 | 4 | 3.7 |
| (1-5) | 19.9 | 4.2 | 4.2 | 3.3 | 2.2 | 2.8 | 2.9 | 3 | 2.8 |
| (1-6) | 20.2 | 4.4 | 4.5 | 3.6 | 2.4 | 3.1 | 3.2 | 3.3 | 3.1 |
| (1-7) | 21.1 | 5.4 | 5.5 | 4.6 | 3.4 | 4.1 | 4.1 | 4.3 | 4.1 |
| (1-8) | 20.7 | 5 | 5.1 | 4.2 | 3 | 3.7 | 3.7 | 3.9 | 3.7 |
| (1-9) | 20.7 | 5 | 5 | 4.1 | 3 | 3.7 | 3.7 | 3.9 | 3.6 |
| (1-10) | 20.6 | 4.9 | 5 | 4.1 | 2.9 | 3.6 | 3.6 | 3.8 | 3.6 |
| (1-11) | 21.1 | 5.3 | 5.4 | 4.5 | 3.3 | 4 | 4.1 | 4.2 | 4 |
| (1-12) | 21.2 | 5.4 | 5.5 | 4.6 | 3.4 | 4.1 | 4.1 | 4.3 | 4.1 |
| (1-13) | 19.8 | 4.1 | 4.1 | 3.2 | 2 | 2.7 | 2.8 | 2.9 | 2.7 |
| (1-14) | 18.8 | 3.1 | 3.1 | 2.3 | 1.1 | 1.8 | 1.8 | 2 | 1.8 |
| (1-15) | 19.5 | 3.8 | 3.8 | 2.9 | 1.8 | 2.5 | 2.5 | 2.6 | 2.4 |

| | | Liquids contained in liquid medium | | | |
|---|---|---|---|---|---|
| Charge transporting substance | SP Value | Phenetole 17.5 | Dibenzyl ether 19.1 | DMDG 16.1 | MFG-Ac 16.8 |
| (1-1) | 20.9 | 3.4 | 1.9 | 4.9 | 4.2 |
| (1-2) | 19.7 | 2.2 | 0.7 | 3.7 | 3.0 |
| (1-3) | 21.3 | 3.8 | 2.2 | 5.2 | 4.5 |
| (1-4) | 20.8 | 3.3 | 1.8 | 4.7 | 4.1 |
| (1-5) | 19.9 | 2.4 | 0.8 | 3.8 | 3.1 |
| (1-6) | 20.2 | 2.7 | 1.1 | 4.1 | 3.4 |
| (1-7) | 21.1 | 3.6 | 2.1 | 5.1 | 4.4 |
| (1-8) | 20.7 | 3.2 | 1.7 | 4.7 | 4.0 |
| (1-9) | 20.7 | 3.2 | 1.6 | 4.6 | 3.9 |
| (1-10) | 20.6 | 3.1 | 1.6 | 4.6 | 3.9 |
| (1-11) | 21.1 | 3.6 | 2.0 | 5.0 | 4.3 |
| (1-12) | 21.2 | 3.7 | 2.1 | 5.1 | 4.4 |
| (1-13) | 19.8 | 2.3 | 0.7 | 3.7 | 3.0 |
| (1-14) | 18.8 | 1.3 | 0.2 | 2.8 | 2.1 |
| (1-15) | 19.5 | 2.0 | 0.4 | 3.4 | 2.7 |

TABLE 7

Difference in SP Value of charge transporting substance and SP Value of liquids contained in liquid medium at heating temperature of 110° C.

| Charge transporting substance | SP Value | Liquids contained in liquid medium | | | | | | | |
|---|---|---|---|---|---|---|---|---|---|
| | | PNB 15.3 | PFG 15 | 2,2,4-trimethyl1-pentanol 16.4 | 3,3-dimethyl1-hexanol 16.5 | 2-methyl2-ethyl1-pentanol 16.8 | Ethylacetyl lactate 16.7 | Ethylene glycol monoethyl ether acrylate 16.5 | Butyl formate >b.p. |
| (1-1) | 20.8 | 5.5 | 5.9 | 4.5 | 4.3 | 4 | 4.1 | 4.3 | — |
| (1-2) | 19.5 | 4.2 | 4.6 | 3.2 | 3 | 2.7 | 2.8 | 3 | — |
| (1-3) | 21.2 | 5.9 | 6.2 | 4.8 | 4.7 | 4.4 | 4.5 | 4.7 | — |
| (1-4) | 20.7 | 5.4 | 5.7 | 4.3 | 4.2 | 3.9 | 4 | 4.2 | — |
| (1-5) | 19.6 | 4.3 | 4.6 | 3.2 | 3.1 | 2.8 | 2.9 | 3.1 | — |
| (1-6) | 20.1 | 4.8 | 5.1 | 3.7 | 3.6 | 3.3 | 3.4 | 3.6 | — |
| (1-7) | 21 | 5.7 | 6.1 | 4.7 | 4.6 | 4.2 | 4.4 | 4.6 | — |
| (1-8) | 20.6 | 5.3 | 5.7 | 4.3 | 4.1 | 3.8 | 3.9 | 4.1 | — |
| (1-9) | 20.6 | 5.3 | 5.6 | 4.2 | 4.1 | 3.8 | 3.9 | 4.1 | — |
| (1-10) | 20.5 | 5.2 | 5.6 | 4.2 | 4.1 | 3.7 | 3.9 | 4.1 | — |
| (1-11) | 20.9 | 5.6 | 5.9 | 4.5 | 4.4 | 4.1 | 4.2 | 4.4 | — |
| (1-12) | 21 | 5.6 | 6 | 4.6 | 4.5 | 4.1 | 4.3 | 4.5 | — |
| (1-13) | 19.7 | 4.4 | 4.7 | 3.3 | 3.2 | 2.9 | 3 | 3.2 | — |
| (1-14) | 18.6 | 3.3 | 3.7 | 2.3 | 2.1 | 1.8 | 1.9 | 2.1 | — |
| (1-15) | 19.2 | 3.9 | 4.2 | 2.8 | 2.7 | 2.4 | 2.5 | 2.7 | — |

| Charge transporting substance | SP Value | Liquids contained in liquid medium | | | |
|---|---|---|---|---|---|
| | | Phenetole 17.3 | Dibenzyl ether 18.8 | DMDG 15.9 | MFG-Ac 16.3 |
| (1-1) | 20.8 | 3.5 | 2.0 | 5.0 | 4.5 |
| (1-2) | 19.5 | 2.2 | 0.7 | 3.7 | 3.2 |
| (1-3) | 21.2 | 3.9 | 2.3 | 5.3 | 4.9 |
| (1-4) | 20.7 | 3.4 | 1.9 | 4.8 | 4.4 |
| (1-5) | 19.6 | 2.3 | 0.7 | 3.7 | 3.3 |
| (1-6) | 20.1 | 2.8 | 1.2 | 4.2 | 3.8 |
| (1-7) | 21.0 | 3.7 | 2.2 | 5.2 | 4.7 |
| (1-8) | 20.6 | 3.3 | 1.8 | 4.8 | 4.3 |
| (1-9) | 20.6 | 3.3 | 1.8 | 4.7 | 4.3 |
| (1-10) | 20.5 | 3.3 | 1.7 | 4.7 | 4.2 |
| (1-11) | 20.9 | 3.6 | 2.0 | 5.0 | 4.6 |
| (1-12) | 21.0 | 3.7 | 2.1 | 5.1 | 4.6 |
| (1-13) | 19.7 | 2.4 | 0.8 | 3.8 | 3.4 |
| (1-14) | 18.6 | 1.3 | 0.2 | 2.8 | 2.3 |
| (1-15) | 19.2 | 1.9 | 0.3 | 3.3 | 2.9 |

TABLE 8

Difference in SP Value of charge transporting substance and SP Value of liquids contained in liquid medium at heating temperature of 120° C.

| Charge transporting substance | SP Value | Liquids contained in liquid medium | | | | | | | |
|---|---|---|---|---|---|---|---|---|---|
| | | PNB 14.8 | PFG 14.3 | 2,2,4-trimethyl1-pentanol 16.1 | 3,3-dimethyl1-hexanol 17.5 | 2-methyl2-ethyl1-pentanol 16.5 | Ethylacetyl lactate 16.5 | Ethylene glycol monoethyl ether acrylate 16.1 | Butyl formate >b.p. |
| (1-1) | 20.7 | 5.9 | 6.4 | 4.6 | 3.2 | 4.2 | 4.2 | 4.6 | — |
| (1-2) | 19.2 | 4.5 | 4.9 | 3.1 | 1.8 | 2.7 | 2.8 | 3.1 | — |
| (1-3) | 21.1 | 6.3 | 6.8 | 5 | 3.6 | 4.5 | 4.6 | 4.9 | — |
| (1-4) | 20.6 | 5.8 | 6.3 | 4.5 | 3.1 | 4.1 | 4.1 | 4.5 | — |
| (1-5) | 19.4 | 4.6 | 5 | 3.3 | 1.9 | 2.8 | 2.9 | 3.2 | — |
| (1-6) | 19.9 | 5.1 | 5.6 | 3.8 | 2.4 | 3.3 | 3.4 | 3.7 | — |
| (1-7) | 20.9 | 6.2 | 6.6 | 4.8 | 3.5 | 4.4 | 4.5 | 4.8 | — |
| (1-8) | 20.5 | 5.7 | 6.2 | 4.4 | 3 | 4 | 4 | 4.4 | — |
| (1-9) | 20.5 | 5.7 | 6.2 | 4.4 | 3 | 4 | 4 | 4.4 | — |
| (1-10) | 20.4 | 5.7 | 6.1 | 4.3 | 3 | 3.9 | 4 | 4.3 | — |
| (1-11) | 20.8 | 6 | 6.5 | 4.7 | 3.3 | 4.2 | 4.3 | 4.6 | — |
| (1-12) | 20.7 | 5.9 | 6.3 | 4.5 | 3.2 | 4.1 | 4.2 | 4.5 | — |
| (1-13) | 19.6 | 4.8 | 5.3 | 3.5 | 2.1 | 3 | 3.1 | 3.4 | — |
| (1-14) | 18.3 | 3.6 | 4 | 2.2 | 0.9 | 1.8 | 1.9 | 2.2 | — |
| (1-15) | 18.9 | 4.1 | 4.6 | 2.8 | 1.4 | 2.3 | 2.4 | 2.8 | — |

TABLE 8-continued

| Charge transporting substance | SP Value | Liquids contained in liquid medium | | | |
|---|---|---|---|---|---|
| | | Phenetole 17.0 | Dibenzyl ether 18.6 | DMDG 15.5 | MFG-Ac 15.8 |
| (1-1) | 20.7 | 3.7 | 2.1 | 5.2 | 4.9 |
| (1-2) | 19.2 | 2.3 | 0.6 | 3.7 | 3.4 |
| (1-3) | 21.1 | 4.1 | 2.5 | 5.6 | 5.2 |
| (1-4) | 20.6 | 3.6 | 2.0 | 5.1 | 4.8 |
| (1-5) | 19.4 | 2.4 | 0.7 | 3.8 | 3.5 |
| (1-6) | 19.9 | 2.9 | 1.2 | 4.3 | 4.0 |
| (1-7) | 20.9 | 4.0 | 2.3 | 5.4 | 5.1 |
| (1-8) | 20.5 | 3.5 | 1.9 | 5.0 | 4.7 |
| (1-9) | 20.5 | 3.5 | 1.9 | 5.0 | 4.7 |
| (1-10) | 20.4 | 3.5 | 1.8 | 4.9 | 4.6 |
| (1-11) | 20.8 | 3.8 | 2.1 | 5.2 | 4.9 |
| (1-12) | 20.7 | 3.7 | 2.0 | 5.1 | 4.8 |
| (1-13) | 19.6 | 2.6 | 0.9 | 4.0 | 3.7 |
| (1-14) | 18.3 | 1.3 | 0.3 | 2.8 | 2.5 |
| (1-15) | 18.9 | 1.9 | 0.3 | 3.4 | 3.1 |

20

TABLE 9

Difference in SP Value of charge transporting substance and SP Value of liquids contained in liquid medium at heating temperature of 130° C.

| Charge transporting substance | SP Value | Liquids contained in liquid medium | | | | | | | |
|---|---|---|---|---|---|---|---|---|---|
| | | PNB 14.3 | PFG 13.5 | 2,2,4-trimethyl1-pentanol 15.7 | 3,3-dimethyl1-hexanol 17.3 | 2-methyl2-ethyl1-pentanol 16.2 | Ethylacetyl lactate 16.1 | Ethylene glycol monoethyl ether acrylate 15.8 | Butyl formate >b.p. |
| (1-1) | 20.7 | 6.4 | 7.2 | 5.0 | 3.4 | 4.5 | 4.6 | 4.9 | — |
| (1-2) | 18.9 | 4.6 | 5.4 | 3.2 | 1.6 | 2.7 | 2.8 | 3.2 | — |
| (1-3) | 21.1 | 6.7 | 7.6 | 5.3 | 3.8 | 4.9 | 5.0 | 5.3 | — |
| (1-4) | 20.5 | 6.2 | 7.0 | 4.8 | 3.2 | 4.3 | 4.4 | 4.7 | — |
| (1-5) | 19.1 | 4.7 | 5.5 | 3.3 | 1.8 | 2.9 | 3.0 | 3.3 | — |
| (1-6) | 19.8 | 5.4 | 6.2 | 4.0 | 2.5 | 3.6 | 3.7 | 4.0 | — |
| (1-7) | 20.8 | 6.5 | 7.3 | 5.1 | 3.5 | 4.6 | 4.7 | 5.1 | — |
| (1-8) | 20.4 | 6.1 | 6.9 | 4.7 | 3.1 | 4.2 | 4.3 | 4.6 | — |
| (1-9) | 20.3 | 6.0 | 6.8 | 4.6 | 3.0 | 4.1 | 4.2 | 4.5 | — |
| (1-10) | 20.3 | 5.9 | 6.7 | 4.5 | 3.0 | 4.0 | 4.2 | 4.5 | — |
| (1-11) | 20.7 | 6.3 | 7.1 | 4.9 | 3.3 | 4.4 | 4.6 | 4.9 | — |
| (1-12) | 20.3 | 6.0 | 6.8 | 4.6 | 3.0 | 4.1 | 4.2 | 4.6 | — |
| (1-13) | 19.5 | 5.1 | 6.0 | 3.7 | 2.2 | 3.3 | 3.4 | 3.7 | — |
| (1-14) | 18.1 | 3.8 | 4.6 | 2.4 | 0.8 | 1.9 | 2.0 | 2.4 | — |
| (1-15) | 18.6 | 4.2 | 5.1 | 2.8 | 1.3 | 2.4 | 2.5 | 2.8 | — |

| Charge transporting substance | SP Value | Liquids contained in liquid medium | | | |
|---|---|---|---|---|---|
| | | Phenetole 16.7 | Dibenzyl ether 18.3 | DMDG 15.2 | MFG-Ac 15.4 |
| (1-1) | 20.7 | 4.0 | 2.4 | 5.5 | 5.3 |
| (1-2) | 18.9 | 2.3 | 0.6 | 3.7 | 3.6 |
| (1-3) | 21.1 | 4.4 | 2.8 | 5.9 | 5.7 |
| (1-4) | 20.5 | 3.8 | 2.2 | 5.3 | 5.1 |
| (1-5) | 19.1 | 2.4 | 0.8 | 3.9 | 3.7 |
| (1-6) | 19.8 | 3.1 | 1.4 | 4.6 | 4.4 |
| (1-7) | 20.8 | 4.2 | 2.5 | 5.6 | 5.5 |
| (1-8) | 20.4 | 3.7 | 2.1 | 5.2 | 5.0 |
| (1-9) | 20.3 | 3.6 | 2.0 | 5.1 | 4.9 |
| (1-10) | 20.3 | 3.6 | 1.9 | 5.1 | 4.9 |
| (1-11) | 20.7 | 4.0 | 2.3 | 5.4 | 5.3 |
| (1-12) | 20.3 | 3.6 | 2.0 | 5.1 | 4.9 |
| (1-13) | 19.5 | 2.8 | 1.2 | 4.3 | 4.1 |
| (1-14) | 18.1 | 1.5 | 0.2 | 2.9 | 2.8 |
| (1-15) | 18.6 | 1.9 | 0.3 | 3.4 | 3.2 |

TABLE 10

Difference in SP Value of charge transporting substance and SP Value of liquids contained in liquid medium at heating temperature of 140° C.

| Charge transporting substance | SP Value | Liquids contained in liquid medium | | | | | | | |
|---|---|---|---|---|---|---|---|---|---|
| | | PNB 13.7 | PFG 12.8 | 2,2,4-trimethyl1-pentanol 15.5 | 3,3-dimethyl1-hexanol 17.2 | 2-methyl2-ethyl1-pentanol 15.9 | Ethylacetyl lactate 15.8 | Ethylene glycol monoethyl ether acrylate 15.3 | Butyl formate >b.p. |
| (1-1) | 20.6 | 6.9 | 7.8 | 5.1 | 3.4 | 4.7 | 4.8 | 5.3 | — |
| (1-2) | 18.7 | 5.0 | 5.9 | 3.2 | 1.5 | 2.8 | 2.9 | 3.4 | — |
| (1-3) | 20.9 | 7.1 | 8.0 | 5.3 | 3.7 | 4.9 | 5.1 | 5.5 | — |
| (1-4) | 20.4 | 6.6 | 7.6 | 4.9 | 3.2 | 4.5 | 4.6 | 5.1 | — |
| (1-5) | 18.8 | 5.0 | 6.0 | 3.2 | 1.6 | 2.9 | 3.0 | 3.4 | — |
| (1-6) | 19.7 | 5.9 | 6.9 | 4.1 | 2.5 | 3.7 | 3.9 | 4.3 | — |
| (1-7) | 20.7 | 7.0 | 7.9 | 5.2 | 3.6 | 4.8 | 5.0 | 5.4 | — |
| (1-8) | 20.3 | 6.5 | 7.5 | 4.8 | 3.1 | 4.4 | 4.5 | 4.9 | — |
| (1-9) | 20.2 | 6.5 | 7.4 | 4.7 | 3.0 | 4.3 | 4.4 | 4.9 | — |
| (1-10) | 20.1 | 6.4 | 7.3 | 4.6 | 2.9 | 4.2 | 4.4 | 4.8 | — |
| (1-11) | 20.6 | 6.8 | 7.7 | 5.0 | 3.4 | 4.6 | 4.8 | 5.2 | — |
| (1-12) | 20.0 | 6.3 | 7.2 | 4.5 | 2.9 | 4.1 | 4.3 | 4.7 | — |
| (1-13) | 19.4 | 5.6 | 6.6 | 3.9 | 2.2 | 3.5 | 3.6 | 4.0 | — |
| (1-14) | 17.8 | 4.1 | 5.0 | 2.3 | 0.6 | 1.9 | 2.0 | 2.5 | — |
| (1-15) | 18.4 | 4.6 | 5.6 | 2.9 | 1.2 | 2.5 | 2.6 | 3.1 | — |

| Charge transporting substance | SP Value | Liquids contained in liquid medium | | | |
|---|---|---|---|---|---|
| | | Phenetole 16.4 | Dibenzyl ether 18.1 | DMDG 14.9 | MFG-Ac 14.9 |
| (1-1) | 20.6 | 4.2 | 2.5 | 5.7 | 5.7 |
| (1-2) | 18.7 | 2.3 | 0.6 | 3.8 | 3.8 |
| (1-3) | 20.9 | 4.5 | 2.8 | 6.0 | 6.0 |
| (1-4) | 20.4 | 4.0 | 2.3 | 5.5 | 5.5 |
| (1-5) | 18.8 | 2.4 | 0.7 | 3.9 | 3.9 |
| (1-6) | 19.7 | 3.3 | 1.6 | 4.8 | 4.8 |
| (1-7) | 20.7 | 4.4 | 2.7 | 5.9 | 5.9 |
| (1-8) | 20.3 | 3.9 | 2.2 | 5.4 | 5.4 |
| (1-9) | 20.2 | 3.8 | 2.1 | 5.3 | 5.3 |
| (1-10) | 20.1 | 3.7 | 2.0 | 5.2 | 5.2 |
| (1-11) | 20.6 | 4.2 | 2.5 | 5.7 | 5.7 |
| (1-12) | 20.0 | 3.7 | 1.9 | 5.2 | 5.1 |
| (1-13) | 19.4 | 3.0 | 1.3 | 4.5 | 4.5 |
| (1-14) | 17.8 | 1.4 | 0.3 | 2.9 | 2.9 |
| (1-15) | 18.4 | 2.0 | 0.3 | 3.5 | 3.5 |

Next, a method of forming the coat of the dispersion liquid is described. With respect to the method of forming the coat of the dispersion liquid, all of the existing coating methods, such as dip coating, spray coating, and ring coating, can be used and the dip coating is suitable from the viewpoint of productivity. The coat can be formed by applying the dispersion liquid onto a support in the process.

The coat of the dispersion liquid of the invention may be formed on the charge generating layer or the coat may be formed on the undercoat layer, the charge generating layer may be formed thereon, and then the coat of the dispersion liquid may be formed thereon. When the charge transporting layer is formed with a laminated structure (a first charge transporting layer, a second charge transporting layer), the coat of the dispersion liquid of the invention may be formed on the first charge transporting layer to form the second charge transporting layer. Or, both the first charge transporting layer and the second charge transporting layer may be formed using the coat of the dispersion liquid of the invention.

The film thickness of the charge transporting layer produced by the production method of the invention is suitably 5 μm or more and 50 μm or lower and more suitably 10 μm or more and 35 μm or lower.

Next, the configuration of the electrophotographic photosensitive member produced by the production method of the invention is described.

As the electrophotographic photosensitive member, a cylindrical electrophotographic photosensitive member obtained by forming photosensitive layers (a charge generating layer, a charge transporting layer) on a cylindrical support is generally widely used but the electrophotographic photosensitive member can be formed into the shape of a belt, a sheet, and the like.

The support is suitably one having conductivity (conductive support). A support formed with metal, such as aluminum, aluminum alloy, or stainless steel, can be used. In the case of the support formed with aluminum or aluminum alloy, an ED tube, an EI tube, and the tubes subjected to cutting, electrolytic composite polishing, and wet or dry type honing treatment can also be used. In addition thereto, a metal support and a resin support having a layer coated with aluminum, aluminum alloy, or indium oxide-tin oxide alloy by vacuum deposition can also be used. In addition thereto, a support obtained by impregnating resin or the like with conductive particles, such as carbon black, tin oxide particles, titanium oxide particles, or silver particles and plastic containing a conductive resin can also be used. The surface of the support may be subjected to cutting treatment, surface roughing treatment, alumite treatment, and the like.

Between the support and an undercoat layer or a charge generating layer described later, a conductive layer may be provided. The conductive layer is obtained by forming a coat of a coating liquid for conductive layer in which conductive particles are dispersed in resin on the support, and then drying the coat. As the conductive particles, carbon black, acetylene black, metal powder of aluminum, nickel, iron, nichrome, copper, zinc, and silver, and metal oxide powder of conductive tin oxide and ITO are mentioned, for example.

Mentioned as the resin are, for example, polyester resin, polycarbonate resin, polyvinyl butyral resin, acrylic resin, silicone resine, epoxy resin, melamine resin, urethane resin, phenol resin, and alkyd resin.

Mentioned as a solvent of the coating liquid for conductive layer are, for example, an ether based solvent, an alcohol based solvent, a ketone based solvent, and an aromatic hydrocarbon solvent.

The film thickness of the conductive layer is suitably 0.2 μm or more and 40 μm or lower, more suitably 1 μm or more and 35 μm or lower, and still more suitably 5 μm or more and 30 μm or lower.

Between the support or the conductive layer and the charge generating layer, an undercoat layer may be provided.

The undercoat layer can be formed by forming a coat of a coating liquid for undercoat layer containing resin on the support or the conductive layer, and then drying or curing the coat.

Mentioned as the resin for use in the undercoat layer are, for example, polyacrylic acids, methyl cellulose, ethyl cellulose, polyamide resin, polyimide resin, polyamide imide resin, polyamide acid resin, melamine resin, epoxy resin, polyurethane resin, polyolefin resin, and the like. The resin for use in the undercoat layer is suitably thermoplastic resin. Specifically, thermoplastic polyamide resin or polyolefin resin is suitable. As the polyamide resin, a low crystalline or amorphous nylon copolymer which can be applied in a state of solution is suitable. The polyolefin resin is suitably in a state where the resin can be used as a particle dispersion liquid. It is suitable that the polyolefin resin is dispersed in an aqueous medium.

The film thickness of the undercoat layer is suitably 0.05 μm or more and 30 μm or lower and more suitably 1 μm or more and 25 μm or lower. In the undercoat layer, semiconductive particles, an electron transporting substance, or an electron receiving substance may be compounded.

A charge generating layer is provided on the support, the conductive layer, or the undercoat layer.

Mentioned as charge generating substances for use in the electrophotographic photosensitive member of the invention are, for example, an azo pigment, a phthalocyanine pigment, an indigo pigment, and a perylene pigment. One kind or two or more kinds of these charge generating substances may be used. Among the above, metal phthalocyanines, such as oxytitanium phthalocyanine, hydroxygallium phthalocyanine, and chlorogallium phthalocyanine, have high sensitivity, and thus are suitable.

Mentioned as the binder resin for use in the charge generating layer are, for example, polycarbonate resin, polyester resin, butyral resin, polyvinyl acetal resin, acrylic resin, vinyl acetate resin, and urea resin. Among the above, butyral resin is particularly suitable. One kind or two or more kinds of these resins can be used alone or as a mixture or a copolymer.

The charge generating layer can be formed by forming a coat of a coating liquid for charge generating layer obtained by dispersing a charge generating substance with resin and a solvent on the support, the conductive layer, or the undercoat layer, and then drying the coat. The charge generating layer may be a vapor deposition film of the charge generating substance.

Mentioned as a dispersion method are, for example, methods using a homogenizer, ultrasonic waves, a ball mill, a sand mill, an attritor, and a roll mill.

The ratio of the charge generating substance and the resin is suitably in the range of 1:10 to 10:1 (mass ratio) and, particularly, more suitably in the range of 1:1 to 3:1 (mass ratio).

The solvent for use in the coating liquid for charge generating layer is selected according to the solubility and the dispersion stability of the resin and the charge generating substance to be used. Mentioned as the organic solvent are, for example, an alcohol based solvent, a sulfoxide based solvent, a ketone based solvent, an ether based solvent, an ester based solvent, an aromatic hydrocarbon solvent, and the like.

The film thickness of the charge generating layer is suitably 5 μm or lower and more suitably 0.1 μm or more and 2 μm or lower.

To the charge generating layer, various kinds of sensitizers, antioxidants, ultraviolet absorbers, plasticizers, and the like can be added as required. In order to prevent blocking of the flow of charges in the charge generating layer, an electron transporting substance or an electron receiving substance may be compounded in the charge generating layer.

In the electrophotographic photosensitive member of the invention, it is suitable to provide the charge transporting layer on the charge generating layer. The charge transporting layer of the invention is produced by the above-described production method.

Various kinds of additives can be added to each layer of the electrophotographic photosensitive member of the invention. Mentioned as the additives are, for example, deterioration preventing agents, such as an antioxidant, an ultraviolet absorber, and a light resistant stabilizer, and particles, such as organic particles and inorganic particles. Mentioned as the deterioration preventing agents are, for example, a hindered phenolic antioxidant, a hindered amine based light resistant stabilizer, a sulfur atom-containing antioxidant, and a phosphorus atom-containing antioxidant. Mentioned as the organic particles are, for example, polymer resin particles, such as fluorine atom-containing resin particles, polystyrene particles, and polyethylene resin particles. Mentioned as the inorganic particles are, for example, metal oxides, such as silica and alumina.

When applying the coating liquid of each layer described above, coating methods, such as a dip coating method, a spray coating method, a spinner coating method, a roller coating method, a Meyer bar coating method, and a blade coating method, can be used.

On the surface of a surface layer of the electrophotographic photosensitive member of the invention, a concavo-convex shape (a concave shape, a convex shape) can be formed. As a method of forming the concavo-convex shape, known methods can be employed. As the formation method, a method of forming concave shapes by spraying polishing particles onto the surface, a method of forming concavo-convex shapes by bringing a mold having a concavo-convex shape into contact with the surface under pressure, a method of forming concave shapes by irradiating the surface with laser light, and the like are mentioned. Among the above, the method of forming concavo-convex shapes by bringing a mold having a concavo-convex shape into contact with the surface of the surface layer of the electrophotographic photosensitive member under pressure is suitable.

Figure 2:
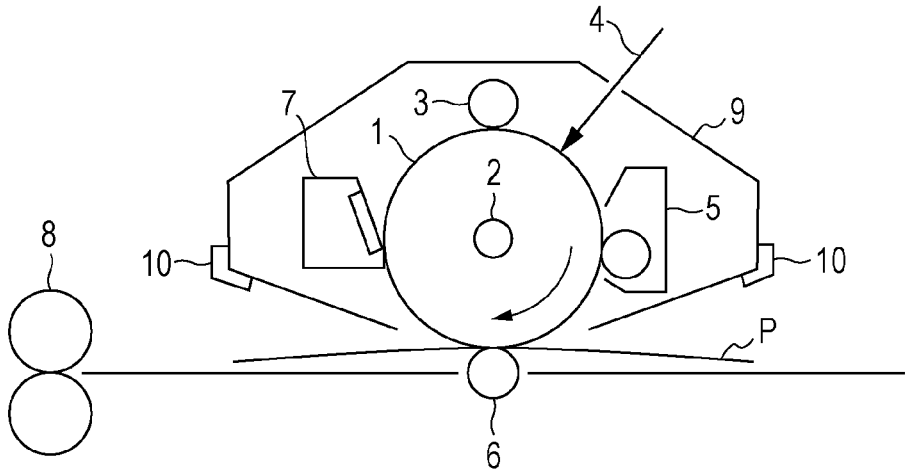
FIG. 2 is a view illustrating one example of a schematic configuration of an electrophotographic apparatus having a process cartridge having an electrophotographic photosensitive member.

FIG. 2 illustrates one example of a schematic configuration of an electrophotographic apparatus provided with a process cartridge having the electrophotographic photosensitive member of the invention.

In FIG. 2, 1 denotes a cylindrical electrophotographic photosensitive member and is rotated at a predetermined peripheral speed in the direction indicated by the arrow around a shaft 2 to be driven.

The surface of the electrophotographic photosensitive member 1 which is driven by rotating is uniformly charged with a predetermined positive or negative potential by a charging unit (primary charging unit: charging roller or the like) 3. Subsequently, the surface receives exposure light (image exposure light) 4 output from an exposure unit (not illustrated), such as slit exposure and laser beam scanning exposure. Thus, on the surface of the electrophotographic photosensitive member 1, an electrostatic latent image corresponding to the target image is sequentially formed.

The electrostatic latent images formed on the surface of the electrophotographic photosensitive member 1 are developed with toner contained in a developer of a developing unit 5 to form toner images. Subsequently, the toner images formed and carried on the surface of the electrophotographic photosensitive member 1 are sequentially transferred by transfer bias from a transfer unit (a transfer roller or the like) 6 to a transfer material (paper or the like) P. The transfer material P is taken out from a transfer material feeder (not illustrated), and then fed to a space (contact portion) between the electrophotographic photosensitive member 1 and the transfer unit 6 while synchronizing with the rotation of the electrophotographic photosensitive member 1.

The transfer material P to which the toner image is transferred is separated from the surface of the electrophotographic photosensitive member 1, introduced to a fixing unit 8 to fix the image, and then printed out to the outside of the apparatus as an image formed substance (a print, a copy).

The surface of the electrophotographic photosensitive member 1 after the toner image is transferred is cleaned by the removal of the untransferred developer (toner) by a cleaning unit (cleaning blade or the like) 7. Subsequently, after being diselectrified by pre-exposure light (not illustrated) from a pre-exposure unit (not illustrated), the electrophotographic photosensitive member 1 is repeatedly used for image formation. As illustrated in FIG. 1, when the charging unit 3 is a contact charging unit using a charging roller or the like, pre-exposure is not necessarily required.

Among the constituent components, such as the electrophotographic photosensitive member 1, the charging unit 3, the developing unit 5, the transfer unit 6, and the cleaning unit 7, a plurality of the constituent components may be accommodated in a container to be integrally combined as a process cartridge, and then the process cartridge may be detachably attached to the main body of the electrophotographic apparatus, such as a copying machine or a laser beam printer. In FIG. 2, the electrophotographic photosensitive member 1 and the charging unit 3, the developing unit 5, and the cleaning unit 7 are integrally supported to form a cartridge to constitute a process cartridge 9 which is detachable to the main body of the electrophotographic apparatus using a guide unit 10, such as a rail of the main body of the electrophotographic apparatus.

EXAMPLES

Specific production examples are described below. However, the invention is not limited thereto. Each ratio in the brackets is based on mass.

Production of Particles 1 to 53

Particles containing a charge transporting substance and a binder resin were produced by the following method. Charge transporting substances and binder resins of the types and the ratios shown in Table 11 were dissolved in tetrahydrofuran in such a manner that the solid content concentration was 3%. The solutions were formed into particles by a spray dry method using a mini spray drier B-290 to which an inert loop B-295 (all manufactured by BUCHI Corporation, to which a Kalrez O-ring was attached) while performing solvent recovery under a nitrogen gas flow. The nitrogen gas flow rate, the inlet temperature, an aspirator, and a pump were set in such a manner that the particle diameter was 2 to 10 μm. Thus, particles 1 to 53 containing the charge transporting substances and the binder resins were produced.

TABLE 11

Production example of particles containing charge transporting substance and binder resin

| | Charge transporting substance | | | | Binder resin | | | |
|---|---|---|---|---|---|---|---|---|
| | Type | Ratio | Type | Ratio | Type | Ratio | Type | Ratio |
| Particles 1 | (1-1) | 0.5 | — | — | (2-1) | 0.5 | — | — |
| Particles 2 | (1-12) | 0.5 | — | — | (2-1) | 0.5 | — | — |
| Particles 3 | (1-3) | 0.5 | — | — | (2-1) | 0.5 | — | — |
| Particles 4 | (1-4) | 0.5 | — | — | (2-1) | 0.5 | — | — |
| Particles 5 | (1-5) | 0.5 | — | — | (2-1) | 0.5 | — | |
| Particles 6 | (1-6) | 0.5 | — | — | (2-1) | 0.5 | — | — |
| Particles 7 | (1-7) | 0.5 | — | — | (2-1) | 0.5 | — | — |
| Particles 8 | (1-8) | 0.5 | — | — | (2-1) | 0.5 | — | |
| Particles 10 | (1-10) | 0.5 | — | — | (2-1) | 0.5 | — | — |
| Particles 11 | (1-11) | 0.5 | — | — | (2-1) | 0.5 | — | — |
| Particles 12 | (1-2) | 0.5 | — | — | (2-1) | 0.5 | — | — |
| Particles 13 | (1-13) | 0.5 | — | — | (2-1) | 0.5 | — | — |
| Particles 14 | (1-1) | 0.5 | — | — | (3-1) | 0.5 | — | — |
| Particles 15 | (1-2) | 0.5 | — | — | (3-1) | 0.5 | — | — |
| Particles 16 | (1-3) | 0.5 | — | — | (3-1) | 0.5 | — | — |
| Particles 17 | (1-4) | 0.5 | — | — | (3-1) | 0.5 | — | — |
| Particles 18 | (1-5) | 0.5 | — | — | (3-1) | 0.5 | — | — |
| Particles 19 | (1-6) | 0.5 | — | — | (3-1) | 0.5 | — | — |
| Particles 20 | (1-7) | 0.5 | — | — | (3-1) | 0.5 | — | — |
| Particles 21 | (1-8) | 0.5 | — | — | (3-1) | 0.5 | — | — |
| Particles 22 | (1-9) | 0.5 | — | — | (3-1) | 0.5 | — | — |
| Particles 23 | (1-10) | 0.5 | — | — | (3-1) | 0.5 | — | — |
| Particles 24 | (1-11) | 0.5 | — | — | (3-1) | 0.5 | — | — |

TABLE 11-continued

| Production example of particles containing charge transporting substance and binder resin | | | | | | | | |
|---|---|---|---|---|---|---|---|---|
| | Charge transporting substance | | | | Binder resin | | | |
| | Type | Ratio | Type | Ratio | Type | Ratio | Type | Ratio |
| Particles 25 | (1-12) | 0.5 | — | — | (3-1) | 0.5 | — | — |
| Particles 26 | (1-13) | 0.5 | — | — | (3-1) | 0.5 | — | — |
| Particles 27 | (1-14) | 0.5 | — | — | (3-1) | 0.5 | — | — |
| Particles 28 | (1-15) | 0.5 | — | — | (3-1) | 0.5 | — | — |
| Particles 29 | (1-1) | 0.25 | (1-2) | 0.25 | (2-2) | 0.5 | — | — |
| Particles 30 | (1-1) | 0.25 | (1-2) | 0.25 | (2-3) | 0.5 | — | — |
| Particles 31 | (1-1) | 0.25 | (1-2) | 0.25 | (2-4) | 0.5 | — | — |
| Particles 32 | (1-1) | 0.25 | (1-1) | 0.25 | (2-5) | 0.5 | — | — |
| Particles 33 | (1-1) | 0.25 | (1-2) | 0.25 | (2-6) | 0.5 | — | — |
| Particles 34 | (1-1) | 0.25 | (1-2) | 0.25 | (2-7) | 0.5 | — | — |
| Particles 35 | (1-1) | 0.25 | (1-3) | 0.25 | (2-8) | 0.5 | — | — |
| Particles 36 | (1-1) | 0.25 | (1-3) | 0.25 | (3-2) | 0.5 | — | — |
| Particles 37 | (1-1) | 0.25 | (1-3) | 0.25 | (3-3) | 0.5 | — | — |
| Particles 38 | (1-1) | 0.25 | (1-3) | 0.25 | (3-4) | 0.5 | — | — |
| Particles 39 | (1-1) | 0.25 | (1-3) | 0.25 | (3-5) | 0.5 | — | — |
| Particles 40 | (1-1) | 0.25 | (1-3) | 0.25 | (3-6) | 0.5 | — | — |
| Particles 41 | (1-4) | 0.4 | — | — | (2-1) | 0.3 | (2-2) | 0.3 |
| Particles 42 | (1-5) | 0.4 | — | — | (2-1) | 0.3 | (2-3) | 0.3 |
| Particles 43 | (1-6) | 0.4 | — | — | (2-1) | 0.3 | (2-4) | 0.3 |
| Particles 44 | (1-7) | 0.4 | — | — | (2-1) | 0.3 | (2-5) | 0.3 |
| Particles 45 | (1-8) | 0.5 | — | — | (2-6) | 0.5 | — | — |
| Particles 46 | (1-9) | 0.4 | — | — | (2-1) | 0.3 | (2-7) | 0.3 |
| Particles 47 | (1-10) | 0.4 | — | — | (2-1) | 0.3 | (2-8) | 0.3 |
| Particles 48 | (1-11) | 0.4 | — | — | (2-1) | 0.3 | (3-1) | 0.3 |
| Particles 49 | (1-12) | 0.4 | — | — | (2-1) | 0.3 | (3-2) | 0.3 |
| Particles 50 | (1-13) | 0.4 | — | — | (2-1) | 0.3 | (3-3) | 0.3 |
| Particles 51 | (1-4) | 0.2 | (1-1) | 0.2 | (2-1) | 0.3 | (3-4) | 0.3 |
| Particles 52 | (1-5) | 0.2 | (1-1) | 0.2 | (2-1) | 0.3 | (3-5) | 0.3 |
| Particles 53 | (1-6) | 0.2 | (1-1) | 0.2 | (2-1) | 0.3 | (3-6) | 0.3 |

The ratio of the charge transporting substance and the binder resin in Table 11 is a ratio (mass ratio) when the total of the ratio of each charge transporting substance and the ratio of each binder resin is 1.

Production of Particles 54 to 73

Particles containing a charge transporting substance were produced by the following method. Charge transporting substances shown in Table 12 were dissolved in tetrahydrofuran in such a manner that the solid content concentration was 3%. The obtained solutions were formed into particles by the same method as that of the production of the particles 1 described above. Then, the nitrogen gas flow rate, the inlet temperature, an aspirator, and a pump were set in such a manner that the particle diameter was 2 to 10 μm. Thus, particles 54 to 73 containing the charge transporting substances were produced.

Production of Particles 74 to 93

Particles containing a binder resin were produced by the following method. Binder resins shown in Table 13 were dissolved in tetrahydrofuran in such a manner that the solid content concentration was 3%. The obtained solutions were formed into particles by the same method as that of the production of the particles 1 described above. Then, the nitrogen gas flow rate, the inlet temperature, an aspirator, and a pump were set in such a manner that the particle diameter was 2 to 10 μm. Thus, particles 74 to 93 containing the binder resins were produced.

TABLE 12

| Production example of particles containing charge transporting substance | |
|---|---|
| | Charge transporting substance |
| Particles 54 | (1-1) |
| Particles 55 | (1-2) |
| Particles 56 | (1-3) |

TABLE 12-continued

| Production example of particles containing charge transporting substance | |
|---|---|
| | Charge transporting substance |
| Particles 57 | (1-4) |
| Particles 58 | (1-5) |
| Particles 59 | (1-6) |
| Particles 60 | (1-7) |
| Particles 61 | (1-8) |
| Particles 62 | (1-9) |
| Particles 63 | (1-10) |
| Particles 64 | (1-11) |
| Particles 65 | (1-12) |
| Particles 66 | (1-13) |
| Particles 67 | (1-14) |
| Particles 68 | (1-15) |
| Particles 69 | (1-1):(1-3) = 5:1 |
| Particles 70 | (1-2):(1-5) = 1:4 |
| Particles 71 | (1-7):(1-9) = 5:5 |
| Particles 72 | (1-1):(1-2):(1-3) = 2:2:1 |
| Particles 73 | (1-7):(1-8):(1-11) = 1:1:1 |

TABLE 13

| Production example of particles containing binder resin | |
|---|---|
| | Binder resin |
| Particles 74 | (2-1) |
| Particles 75 | (2-2) |
| Particles 76 | (2-3) |
| Particles 77 | (2-4) |
| Particles 78 | (2-5) |
| Particles 79 | (2-6) |
| Particles 80 | (2-7) |
| Particles 81 | (2-8) |

TABLE 13-continued

| Production example of particles containing binder resin | |
|---|---|
| | Binder resin |
| Particles 82 | (3-1) |
| Particles 83 | (3-2) |
| Particles 84 | (3-3) |
| Particles 85 | (3-4) |
| Particles 86 | (3-5) |
| Particles 87 | (3-6) |
| Particles 88 | (2-1):(3-1) = 4:1 |
| Particles 89 | (2-1):(3-6) = 1:1 |
| Particles 90 | (2-8):(3-1) = 1:4 |
| Particles 91 | (2-1):(3-1):(3-4) = 2:2:1 |
| Particles 92 | (2-1):(3-5):(3-6) = 1:1:1 |
| Particles 93 | (2-2):(2-7):(3-1) = 1:1:1 |

Preparation of Liquid Media 1 to 34

As liquid medium, liquids shown in Table 2 were mixed at a ratio shown in Table 2. The SP values of liquid media at 25° C. are calculated by the method described above, and are shown in Table 2.

Preparation of Dispersion Liquids 1, 3 to 8, 10 to 24, 26 to 48, 50 to 100

Next, a dispersion liquid in which particles containing a charge transporting substance and a binder resin were dispersed in liquid medium or a dispersion liquid in which particles containing a charge transporting substance and particles containing a binder resin were dispersed in liquid medium was prepared. The types of liquid medium, the particles containing the charge transporting substance and the binder resin, the particles containing the charge transporting substance, and the particles containing the binder resin are shown in Table 14. The particles containing a charge transporting substance and a binder resin were mixed with liquid medium at a ratio with which the solid content was 10% by mass, the mixture was stirred at a temperature of 25° C.±2° C. under atmospheric pressure for 20 minutes at 5,000 rotations/minute using a homogenizer, thereby obtaining dispersion liquids 1 to 53. Similarly, the particles containing the charge transporting substance and the particles containing the binder resin were mixed with liquid medium at a ratio with which the solid content was 10% by mass, the mixture was stirred for 20 minutes at 5,000 rotations/minute using a homogenizer, thereby obtaining dispersion liquids 1, 3 to 8, 10 to 24, 26 to 48, and 50 to 100.

Examples 1, 3 to 8, 10 to 24, 26 to 48, 50 to 100

An aluminum cylinder having a diameter of 24 mm and a length of 257 mm was used as a support (conductive support). Next, 10 parts of $SnO_2$ coated barium sulfate (conductive particles), 2 parts of titanium oxide (resistance adjusting pigment), 6 parts of phenol resin, and 0.001 part of silicone oil (leveling agent) were mixed with a mixed solvent of 4 parts of methanol and 16 parts of methoxy propanol, thereby preparing a coating liquid for conductive layer. The coating liquid for conductive layer was applied onto the support by dip coating, the obtained coat was heated at 140° C. for 30 minutes, thereby forming a conductive layer having a film thickness of 15 μm.

Next, 3 parts of N-methoxy methylated nylon and 3 parts of nylon copolymer were dissolved in a mixed solvent of 65 parts of methanol and 30 parts of n-butanol, thereby preparing a coating liquid for undercoat layer. The coating liquid for undercoat layer was applied onto the conductive layer by dip coating, and then the obtained coat was dried at 100° C. for 10 minutes, thereby forming an undercoat layer having a film thickness of 0.7 μm.

Next, 10 parts of hydroxy gallium phthalocyanine (charge generating substance) in a crystal form having an intense peak at Bragg angles (2θ±0.2°) of 7.5°, 9.9°, 16.3°, 18.6°, 25.1°, and 28.3° was prepared. With the hydroxy gallium phthalocyanine, 250 parts of cyclohexanone and 5 parts of polyvinyl butyral resin (Product name: S-LEC BX-1, manufactured by Sekisui Chemical Co., Ltd.) were mixed. Then, the mixture was dispersed under an environment of 23±3° C. for 1 hour in a sand mill device using 1 mm diameter glass beads. After the dispersion, 250 parts of ethyl acetate was added, thereby preparing a coating liquid for charge generating layer. The coating liquid for charge generating layer was applied onto the undercoat layer by dip coating, and then the obtained coat was dried at 100° C. for 10 minutes, thereby forming an undercoat layer having a film thickness of 0.26 μm.

Next, the dispersion liquid 1 described above was used as a coating liquid for charge transporting layer. The dispersion liquid 1 was applied onto the charge generating layer by dip coating, and then the obtained coat was heated at a drying temperature shown in Table 14, thereby forming a charge transporting layer. The conditions of the dip coating were adjusted in such a manner that the film thickness of the charge transporting layer after drying was 15 μm. Thus, an electrophotographic photosensitive member was produced.

In examples 2 to 8, 10 to 24, 26 to 48, 50 to 100, electrophotographic photosensitive members were produced using the same method as that of Example 1.

TABLE 14

Type of particles and liquid medium in dispersion liquid and heating temperature when heating coat

| | Dispersion liquid | Particles | Liquid medium | Drying temperature (° C.) | | Dispersion liquid | Particles | Liquid medium | Drying temperature (° C.) |
|---|---|---|---|---|---|---|---|---|---|
| Examples 1 | 1 | Particles 1 | 1 | 120 | Examples 53 | 53 | Particles 53 | 16 | 130 |
| Examples 3 | 3 | Particles 3 | 3 | 120 | Examples 54 | 54 | Particles 54:Particles 88 = 1:1 | 1 | 120 |
| Examples 4 | 4 | Particles 4 | 4 | 120 | Examples 55 | 55 | Particles 55:Particles 89 = 1:1 | 2 | 120 |
| Examples 5 | 5 | Particles 5 | 5 | 120 | Examples 56 | 56 | Particles 56:Particles 90 = 1:1 | 17 | 120 |
| Examples 6 | 6 | Particles 6 | 6 | 120 | Examples 57 | 57 | Particles 57:Particles 91 = 1:1 | 4 | 120 |
| Examples 7 | 7 | Particles 7 | 7 | 120 | Examples 58 | 58 | Particles 58:Particles 92 = 1:1 | 5 | 120 |
| Examples 8 | 8 | Particles 8 | 8 | 120 | Examples 59 | 59 | Particles 59:Particles 93 = 1:1 | 6 | 120 |
| Examples 10 | 10 | Particles 10 | 10 | 120 | Examples 60 | 60 | Particles 60:Particles 80 = 1:1 | 7 | 120 |
| Examples 11 | 11 | Particles 11 | 11 | 120 | Examples 61 | 61 | Particles 61:Particles 81 = 1:1 | 8 | 120 |
| Examples 12 | 12 | Particles 12 | 12 | 120 | Examples 62 | 62 | Particles 62:Particles 82 = 1:1 | 9 | 120 |
| Examples 13 | 13 | Particles 13 | 13 | 120 | Examples 63 | 63 | Particles 63:Particles 83 = 1:1 | 10 | 120 |
| Examples 14 | 14 | Particles 14 | 14 | 120 | Examples 64 | 64 | Particles 64:Particles 84 = 1:1 | 11 | 120 |
| Examples 15 | 15 | Particles 15 | 15 | 120 | Examples 65 | 65 | Particles 65:Particles 85 = 1:1 | 2 | 120 |

TABLE 14-continued

Type of particles and liquid medium in dispersion liquid and heating temperature when heating coat

| | Dispersion liquid | Particles | Liquid medium | Drying temperature (° C.) | | Dispersion liquid | Particles | Liquid medium | Drying temperature (° C.) |
|---|---|---|---|---|---|---|---|---|---|
| Examples 16 | 16 | Particles 16 | 16 | 120 | Examples 66 | 66 | Particles 66:Particles 86 = 1:1 | 13 | 120 |
| Examples 17 | 17 | Particles 17 | 17 | 120 | Examples 67 | 67 | Particles 67:Particles 87 = 1:1 | 14 | 120 |
| Examples 18 | 18 | Particles 18 | 18 | 120 | Examples 68 | 68 | Particles 68:Particles 88 = 1:1 | 15 | 120 |
| Examples 19 | 19 | Particles 19 | 6 | 120 | Examples 69 | 69 | Particles 69:Particles 74 = 1:1 | 4 | 120 |
| Examples 20 | 20 | Particles 20 | 6 | 120 | Examples 70 | 70 | Particles 70:Particles 75 = 1:1 | 16 | 120 |
| Examples 21 | 21 | Particles 21 | 6 | 120 | Examples 71 | 71 | Particles 71:Particles 76 = 1:1 | 18 | 120 |
| Examples 22 | 22 | Particles 22 | 6 | 120 | Examples 72 | 72 | Particles 72:Particles 77 = 1:1 | 2 | 120 |
| Examples 23 | 23 | Particles 23 | 6 | 120 | Examples 73 | 73 | Particles 73:Particles 78 = 1:1 | 2 | 120 |
| Examples 24 | 24 | Particles 24 | 6 | 110 | Examples 74 | 74 | Particles 55:Particles 79 = 1:1 | 9 | 120 |
| Examples 26 | 26 | Particles 26 | 10 | 130 | Examples 75 | 75 | Particles 54:Particles 74 = 5:4 | 2 | 120 |
| Examples 27 | 27 | Particles 27 | 10 | 110 | Examples 76 | 76 | Particles 54:Particles 82 = 5:3 | 3 | 120 |
| Examples 28 | 28 | Particles 28 | 10 | 130 | Examples 77 | 77 | Particles 69:Particles 82 = 5:4 | 4 | 120 |
| Examples 29 | 29 | Particles 29 | 10 | 130 | Examples 78 | 78 | Particles 1:Particles 55:Particles 74 = 1:1:2 | 1 | 120 |
| Examples 30 | 30 | Particles 30 | 10 | 110 | Examples 79 | 79 | Particles 12:Particles 55:Particles 82 = 2:1:3 | 3 | 120 |
| Examples 31 | 31 | Particles 31 | 18 | 130 | Examples 80 | 80 | Particles 69:Particles 88:Particles 16 = 2:2:1 | 2 | 120 |
| Examples 32 | 32 | Particles 32 | 18 | 130 | Examples 81 | 81 | Particles 29:Particles 82 = 4:1 | 4 | 120 |
| Examples 33 | 33 | Particles 33 | 9 | 110 | Examples 82 | 82 | Particles 35:Particles 82 = 4:1 | 5 | 120 |
| Examples 34 | 34 | Particles 34 | 18 | 110 | Examples 83 | 83 | Particles 41:Particles 54 = 2:1 | 6 | 120 |
| Examples 35 | 35 | Particles 35 | 18 | 140 | Examples 84 | 84 | Particles 44:Particles 56 = 2:1 | 7 | 120 |
| Examples 36 | 36 | Particles 36 | 18 | 120 | Examples 85 | 85 | Particles 2 | 19 | 130 |
| Examples 37 | 37 | Particles 37 | 1 | 110 | Examples 86 | 86 | Particles 55:Part icles 66:Particles 74 = 0.2:0.2:0.6 | 20 | 140 |
| Examples 38 | 38 | Particles 38 | 2 | 120 | Examples 87 | 87 | Particles 29 | 21 | 140 |
| Examples 39 | 39 | Particles 39 | 3 | 120 | Examples 88 | 88 | Particles 12 | 22 | 140 |
| Examples 40 | 40 | Particles 40 | 4 | 120 | Examples 89 | 89 | Particles 3:Particles 27 = 1:1 | 23 | 120 |
| Examples 41 | 41 | Particles 41 | 5 | 120 | Examples 90 | 90 | Particles 4 | 24 | 140 |
| Examples 42 | 42 | Particles 42 | 6 | 120 | Examples 91 | 91 | Particles 1 | 25 | 140 |
| Examples 43 | 43 | Particles 43 | 7 | 120 | Examples 92 | 92 | Particles 5 | 26 | 120 |
| Examples 44 | 44 | Particles 44 | 8 | 120 | Examples 93 | 93 | Particles 54:Particles 64:Particles 68:Particles 88 = 0.2:0.2:0.1:0.5 | 27 | 140 |
| Examples 45 | 45 | Particles 45 | 9 | 120 | Examples 94 | 94 | Particles 19 | 28 | 140 |
| Examples 46 | 46 | Particles 46 | 10 | 120 | Examples 95 | 95 | Particles 20 | 29 | 140 |
| Examples 47 | 47 | Particles 47 | 16 | 110 | Examples 96 | 96 | Particles 8 | 30 | 120 |
| Examples 48 | 48 | Particles 48 | 16 | 110 | Examples 97 | 97 | Particles 22 | 31 | 140 |
| Examples 50 | 50 | Particles 50 | 16 | 120 | Examples 98 | 98 | Particles 47 | 32 | 120 |
| Examples 51 | 51 | Particles 51 | 16 | 120 | Examples 99 | 99 | Particles 53 | 33 | 140 |
| Examples 52 | 52 | Particles 52 | 16 | 120 | Examples 100 | 100 | Particles 49 | 34 | 120 |

Coating Liquids for Comparative Examples 1 to 5

5 parts by mass of charge transporting substances shown in Table 15 and 5 parts by mass of binder resins shown in Table 15 were dissolved in 90 parts by mass of liquid media shown in Table 15, thereby preparing solutions (100 parts by mass) of coating liquids for comparative examples (coating liquids for charge transporting layer).

Differences in the SP value between the charge transporting substance and liquid medium of each of the coating liquids for comparative examples were shown in Table 16. In any case, the charge transporting substance and the binder resin dissolved with liquid medium.

Coating Liquids for Comparative Examples 6 to 8

Particles were produced by the same method as the method of producing the particles 1 containing the charge transporting substance and the binder resin using charge transporting substances and binder resins shown in Table 15. The mixing ratio of the charge transporting substance and the binder resin was 1:1. The obtained particles were dispersed in liquid media shown in Table 15 by the same method as that of the preparation of the dispersion liquid 1, thereby preparing coating liquids for comparative examples. Differences in the SP value between the charge transporting substance and liquid medium were shown in Tables 16 and 17. In the case of the coating liquid for comparative example 6, the dispersion liquid caused aggregation or uneven dissolution, so that a uniform solution or a uniform dispersion liquid was not able to be prepared.

Comparative Examples 1 to 8

The coating liquids for comparative examples 1 to 8 were applied by dip coating in the same manner as in Example 1, thereby forming 15 μm thick charge transporting layers. The heating temperature was 130° C. Differences between the SP value of the charge transporting substances and the SP value of the liquids contained in liquid medium at 130° C. in the coating liquids for comparative examples 7 and 8 were shown in Table 19. In Comparative Example 6, the film thickness of the charge transporting layer varied depending on the position of the electrophotographic photosensitive member, so that the charge transporting layer having a uniform film thickness was not able to be formed.

TABLE 15

| | Charge transporting substance | Binder resin | Liquid medium |
|---|---|---|---|
| Coating liquid for Comparative Example 1 | (1-3) | (2-1) | Tetrahydrofuran (THF) |

TABLE 15-continued

| | Charge transporting substance | Binder resin | Liquid medium |
|---|---|---|---|
| Coating liquid for Comparative Example 2 | (1-5) | (2-1) | Monochlorobenzene |
| Coating liquid for Comparative Example 3 | (1-6):(1-4) = 1:1 | (3-1) | Toluene |
| Coating liquid for Comparative Example 4 | (1-3) | (3-1) | Toluene:THF = 50:50 |
| Coating liquid for Comparative Example 5 | (1-2) | (2-1) | o-xylene |
| Coating liquid for Comparative Example 6 | (1-7) | (2-1) | Water:THF = 10:90 |
| Coating liquid for Comparative Example 7 | (1-14) | (2-1) | Water:methyl glycolate = 30:70 |
| Coating liquid for Comparative Example 8 | (1-15) | (3-1) | Water:THF:methyl glycolate = 20:20:60 |

TABLE 16

| | Liquid medium | | Charge transporting substance | | Difference in SP |
|---|---|---|---|---|---|
| | Composition | SP Value | Type | SP Value | value at 25° C. |
| Coating liquid for Comparative Example 1 | Tetrahydrofuran (THF) | 19.5 | (1-3) | 21.8 | 2.3 |
| Coating liquid for Comparative Example 2 | Mono-chlorobenzene | 19.6 | (1-5) | 21.7 | 2.1 |
| Coating liquid for Comparative Example 3 | Toluene | 18.2 | (1-4) | 21.5 | 3.3 |
| Coating liquid for Comparative Example 3 | Toluene | 18.2 | (1-6) | 21.0 | 2.8 |
| Coating liquid for Comparative Example 4 | Toluene:THF = 50:50 | 18.4 | (1-3) | 21.8 | 3.4 |
| Coating liquid for Comparative Example 5 | o-xylene | 18.1 | (1-2) | 21.8 | 3.7 |

TABLE 17

| | Liquid medium | | Charge transporting substance | | Difference in SP |
|---|---|---|---|---|---|
| | Composition | SP Value | Type | SP Value | value at 25° C. |
| Coating liquid for Comparative Example 6 | Water:THF = 10:90 | 21.3 | (1-7) | 21.8 | 0.5 |
| Coating liquid for Comparative Example 7 | Water:methyl glycolate = 30:70 | 36.1 | (1-14) | 20.5 | 15.6 |
| Coating liquid for Comparative Example 8 | Water:THF:methyl glycolate = 20:20:60 | 31.6 | (1-15) | 21.3 | 10.3 |

TABLE 18

| | Liquid medium | | Binder resin | | Difference in SP |
|---|---|---|---|---|---|
| | Composition | SP Value | Type | SP Value | value at 25° C. |
| Coating liquid for Comparative Example 1 | Tetrahydrofuran (THF) | 19.5 | (2-1) | 21.5 | 2.0 |
| Coating liquid for Comparative Example 2 | Monochlorobenzene | 19.6 | (2-1) | 21.5 | 1.9 |
| Coating liquid for Comparative Example 3 | Toluene | 18.2 | (3-1) | 21.9 | 3.7 |
| Coating liquid for Comparative Example 4 | Toluene:THF = 50:50 | 18.4 | (3-1) | 21.9 | 3.5 |
| Coating liquid for Comparative Example 5 | o-xylene | 18.1 | (2-1) | 21.5 | 3.4 |
| Coating liquid for Comparative Example 6 | Water:THF = 10:90 | 21.3 | (2-1) | 21.5 | 0.2 |
| Coating liquid for Comparative Example 7 | Water:methyl glycolate = 30:70 | 36.1 | (2-1) | 21.5 | 14.6 |
| Coating liquid for Comparative Example 8 | Water:THF:methyl glycolate = 20:20:60 | 31.6 | (3-1) | 21.9 | 9.7 |

TABLE 19

Difference in SP Value of charge transporting substance and SP Value of liquids contained in liquid medium at heating temperature of 130° C.

| | Charge transporting substance | | Liquid medium | | Differ-ence |
|---|---|---|---|---|---|
| | Compo-sition | SP Value at 130° C. | Highest boiling point | SP Value at 130° C. | in SP value at 130° C. |
| Coating liquid for Comparative Example 7 | (1-14) | 18.1 | Methyl glycolate | 27.6 | 9.5 |
| Coating liquid for Comparative Example 8 | (1-15) | 18.6 | Methyl glycolate | 27.6 | 9.0 |

Next, evaluation of Examples 1 to 100 and Comparative Examples 1 to 5 and 7 to 8 is described.

Viscosity Change in Dispersion Liquid

With respect to the viscosity of the dispersion liquid (coating liquid for charge transporting layer) immediately after the preparation, the initial viscosity at a shear rate of 10 (1/s) was measured by placing a corn-shaped plate having a diameter of 75 mm in a rotation type viscosity meter MCR300 manufactured by Anton Paar. The coating liquid for charge transporting layer was stirred for 8 hours, the viscosity after 8 hours passed was similarly measured, and then the increase ratio of the viscosity was calculated. The results are shown in Table 20.

Film Thickness Change

The coating liquid for charge transporting layer was applied onto the charge generating layer by dip coating under an environment of a temperature of 25° C.±2° C. and a humidity of 50%±10%. The pulling up speed from the coating liquid for charge transporting layer was adjusted in such a manner that the film thickness of a charge transporting layer formed using each coating liquid for charge transporting layer immediately after the preparation was 15 μm. The film thickness of the charge transporting layer formed using the coating liquid for charge transporting layer immediately after the preparation and the film thickness of the charge transporting layer formed using the coating liquid for charge transporting layer after stirred for 8 hours were measured as follows, so that the change ratio of the film thickness was determined. The film thickness of the central portion in the longitudinal direction of the aluminum cylinder was measured at 6 portions in the circumferential direction using an eddy-current film thickness meter, and the values were averaged, so that the change ratio of the film thickness of the charge transporting layer formed using the coating liquid for charge transporting layer after stirred for 8 hours to the film thickness of the charge transporting layer formed using the coating liquid for charge transporting layer immediately after the preparation was calculated. The results are shown in Table 20.

Image Evaluation

The electrophotographic photosensitive member having the charge transporting layer formed using the coating liquid for charge transporting layer immediately after the preparation was placed in a laser beam printer LBP-2510 manufactured by CANON KABUSHIKI KAISHA, and then image evaluation was performed. With respect to the charge potential (dark portion potential) and the exposure amount (image exposure amount) of a 780 nm laser light source of the electrophotographic photosensitive member, it was modified in such a manner that the amount of light of the surface of the electrophotographic photosensitive member was 0.3 $\mu J/cm^2$. The evaluation was performed under an environment of a temperature of 23° C. and a relative humidity of 15%. As image evaluation, a monochromatic halftone image was output using A4 size regular paper, and then the output image was visually evaluated according to the following criteria. The results are shown in Table 20.

Rank A: Totally uniform image

Rank B: Image having slight image unevenness in a small portion

Rank C: Image having image unevenness

Rank D: Image having noticeable image unevenness

TABLE 20

| | Viscosity change (%) | Film thickness change (%) | Image evaluation |
|---|---|---|---|
| Examples 1 | 0.2 | 1.0 | A |
| Examples 3 | 2.4 | 3.4 | A |
| Examples 4 | 2.1 | 2.7 | B |
| Examples 5 | 1.5 | 2.2 | B |
| Examples 6 | 0.2 | 1.0 | A |
| Examples 7 | 1.4 | 1.5 | A |
| Examples 8 | 1.9 | 1.0 | A |
| Examples 10 | 2.0 | 1.3 | B |
| Examples 11 | 0.2 | 1.0 | A |
| Examples 12 | 0.2 | 1.2 | B |
| Examples 13 | 0.2 | 1.0 | A |
| Examples 14 | 1.1 | 1.6 | B |
| Examples 15 | 1.0 | 1.7 | B |
| Examples 16 | 1.1 | 1.6 | A |
| Examples 17 | 2.1 | 3.2 | A |
| Examples 18 | 1.7 | 1.6 | A |
| Examples 19 | 0.2 | 1.0 | B |
| Examples 20 | 0.3 | 1.2 | A |
| Examples 21 | 0.2 | 1.4 | A |
| Examples 22 | 0.3 | 1.0 | A |
| Examples 23 | 0.3 | 1.0 | B |
| Examples 24 | 0.2 | 1.0 | A |
| Examples 26 | 2.0 | 2.0 | A |
| Examples 27 | 1.4 | 1.4 | B |

TABLE 20-continued

| | Viscosity change (%) | Film thickness change (%) | Image evaluation |
|---|---|---|---|
| Examples 28 | 1.6 | 2.0 | A |
| Examples 29 | 1.2 | 1.0 | A |
| Examples 30 | 1.4 | 1.2 | A |
| Examples 31 | 1.6 | 1.4 | B |
| Examples 32 | 1.7 | 1.5 | A |
| Examples 33 | 2.1 | 2.5 | A |
| Examples 34 | 1.0 | 1.1 | B |
| Examples 35 | 1.7 | 1.2 | B |
| Examples 36 | 2.3 | 1.3 | A |
| Examples 37 | 0.2 | 1.0 | A |
| Examples 38 | 2.8 | 4.4 | A |
| Examples 39 | 2.1 | 2.2 | B |
| Examples 40 | 2.3 | 2.0 | A |
| Examples 41 | 1.5 | 2.8 | A |
| Examples 42 | 0.2 | 2.7 | A |
| Examples 43 | 1.7 | 1.6 | B |
| Examples 44 | 0.8 | 1.4 | B |
| Examples 45 | 2.7 | 4.1 | A |
| Examples 46 | 1.8 | 1.0 | A |
| Examples 47 | 1.1 | 1.2 | B |
| Examples 48 | 1.3 | 1.4 | A |
| Examples 50 | 1.1 | 1.2 | A |
| Examples 51 | 0.9 | 1.4 | B |
| Examples 52 | 1.1 | 1.2 | A |
| Examples 53 | 1.3 | 1.4 | A |
| Examples 54 | 0.2 | 1.0 | B |
| Examples 55 | 1.0 | 4.0 | A |
| Examples 56 | 1.2 | 3.0 | A |
| Examples 57 | 0.4 | 4.0 | A |
| Examples 58 | 1.0 | 3.0 | B |
| Examples 59 | 1.2 | 3.0 | A |
| Examples 60 | 1.2 | 4.0 | B |
| Examples 61 | 0.7 | 2.0 | A |
| Examples 62 | 0.6 | 4.4 | A |
| Examples 63 | 1.2 | 3.0 | A |
| Examples 64 | 0.4 | 2.8 | B |
| Examples 65 | 1.2 | 4.4 | A |
| Examples 66 | 0.4 | 3.0 | A |
| Examples 67 | 1.2 | 4.0 | A |
| Examples 68 | 0.2 | 3.0 | A |
| Examples 69 | 1.2 | 2.0 | B |
| Examples 70 | 1.2 | 4.0 | A |
| Examples 71 | 0.2 | 4.0 | B |
| Examples 72 | 1.0 | 3.0 | A |
| Examples 73 | 1.4 | 4.0 | B |
| Examples 74 | 1.0 | 2.6 | A |
| Examples 75 | 1.0 | 3.8 | A |
| Examples 76 | 1.0 | 2.4 | A |
| Examples 77 | 1.2 | 2.2 | A |
| Examples 78 | 0.2 | 1.0 | B |
| Examples 79 | 1.0 | 2.4 | A |
| Examples 80 | 1.2 | 3.2 | A |
| Examples 81 | 0.8 | 2.2 | A |
| Examples 82 | 0.2 | 2.0 | A |
| Examples 83 | 0.2 | 1.4 | A |
| Examples 84 | 0.3 | 1.8 | A |
| Examples 85 | 1.4 | 1.0 | A |
| Examples 86 | 1.5 | 1.0 | A |
| Examples 87 | 1.0 | 1.5 | A |
| Examples 88 | 1.0 | 1.0 | A |
| Examples 89 | 1.1 | 1.2 | A |
| Examples 90 | 1.3 | 1.3 | A |
| Examples 91 | 2.4 | 1.3 | A |
| Examples 92 | 0.9 | 0.8 | B |
| Examples 93 | 2.4 | 3.2 | A |
| Examples 94 | 0.4 | 1.3 | B |
| Examples 95 | 0.6 | 1.6 | B |
| Examples 96 | 2.1 | 2.3 | A |
| Examples 97 | 2.3 | 3.5 | B |
| Examples 98 | 1.3 | 1.5 | A |
| Examples 99 | 1.0 | 2.1 | B |
| Examples 100 | 1.0 | 2.2 | B |
| Comparative Example 1 | 20.3 | 14.4 | B |
| Comparative Example 2 | 17.9 | 11.8 | A |
| Comparative Example 3 | 17.0 | 11.4 | A |
| Comparative Example 4 | 18.5 | 13.2 | A |
| Comparative Example 5 | 16.5 | 10.4 | A |

TABLE 20-continued

| | Viscosity change (%) | Film thickness change (%) | Image evaluation |
|---|---|---|---|
| Comparative Example 6 | — | — | — |
| Comparative Example 7 | 7.4 | 6.8 | D |
| Comparative Example 8 | 8.6 | 7.5 | D |

The comparison between Examples and Comparative Examples 1 to 5 shows that the results are obtained in Comparative Examples 1 to 5 in which the viscosity considerably changes, and when a coat is formed using the coating liquid for charge transporting layer, and then the charge transporting layer is formed, the film thickness of the charge transporting layer considerably changes. When stably producing the electrophotographic photosensitive member, it is required to add a solvent in order to suppress the viscosity increase or, to perform the application while controlling the application speed in order to achieve a uniform film thickness of the charge transporting layer with time. In Examples, the results are obtained in which the viscosity change of the coat is small and the film thickness change after stirring the charge transporting layer coating liquid is small. This is considered to be because the charge transporting substance and the binder resin are dispersed in liquid medium, and thus, even when the amount of liquid medium decreases due to evaporation of liquid medium, the charge transporting substance and the binder resin are hard to dissolve with liquid medium, so that the viscosity change becomes small. Thus, the method of producing the charge transporting layer of the invention is excellent in that the frequencies of the viscosity control and the application speed control of the coating liquid can be reduced.

When comparing Examples and Comparative Examples 6 to 9, the charge transporting layer coating liquid caused aggregation or uneven dissolution, so that dispersion was not completed and the film thickness of the charge transporting layer varied depending on the position of the electrophotographic photosensitive member, so that a charge transporting layer having a uniform film thickness was not able to be formed in Comparative Examples 6 to 9. This is considered to be because the difference between the SP value of the charge transporting substance and the SP value of the liquid medium at 25° C. is small, and thus the charge transporting substances partially dissolved in the liquid medium. This is also considered to be because the charge transporting substance did not sufficiently dissolve, and thus a solution was not formed. In Examples, the difference between the SP value of the charge transporting substance and the SP value of liquid medium at 25° C. is 7.5 or more. These results show that the use of liquid medium in which the difference between the SP value of the charge transporting substance and the SP value of liquid medium at 25° C. is 7.5 or more is suitable as the production method including the formation of the charge transporting layer of the electrophotographic photosensitive member.

When comparing Examples and Comparative Examples 10 and 11, although the dispersion liquid (charge transporting layer coating liquid) was able to be prepared at 25° C. in Comparative Examples 10 and 11, a charge transporting layer having sufficient electrophotographic characteristics was not able to be formed. This is considered to be because the difference between the SP value of the charge transporting substance and the SP value of liquid medium at 25° C. is 7.5 or more but the difference between of the charge transporting substance and the SP value of the liquid whose boiling point under one atmospheric pressure is the highest among the liquids contained in liquid medium at the heating temperature of the coat is large. The fact that the difference in the SP value at the heating temperature of the coat is large shows that the charge transporting substance forming the particles is hard to dissolve in liquid during heating, so that the shape of the particles is likely to be maintained. As a result, in the charge transporting layer, the uniformity of the film thickness decreased. On the other hand, in Examples, the difference between of the charge transporting substance and the SP value of the liquid whose boiling point under one atmospheric pressure is the highest among the liquids contained in liquid medium at the heating temperature of the coat is 6.8 or lower. These results show that the use of the dispersion liquid in which the difference between of the charge transporting substance and the SP value of the liquid whose boiling point under one atmospheric pressure is the highest among the liquids contained in liquid medium at the heating temperature of the coat is 6.8 or lower is suitable as the production method including the formation of the charge transporting layer of the electrophotographic photosensitive member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-127139 filed Jun. 4, 2012 and No. 2013-090806 filed Apr. 23, 2013, which are hereby incorporated by reference herein in their entirety.

The invention claimed is:

1. A method of producing an electrophotographic photosensitive member which comprises a support and a charge transporting layer formed thereon, comprising the steps of:

preparing a dispersion liquid comprising:

particles comprising a charge transporting substance and a binder resin, and liquid medium;

forming a coat of the dispersion liquid;

heating the coat to dissolve the particles with liquid medium; and drying the coat to form the charge transporting layer;

wherein liquid medium comprises at least one selected from the group consisting of propylene glycol monopropyl ether, propylene glycol-n-butyl ether, 3,3-dimethyl-1-hexanol, ethyl acetyl lactate, 2,2,4-trimethyl-1-pentanol, 2-methyl-2-ethyl-1-pentanol, ethylene glycol monoethyl ether acrylate, butyl formate, phenetole, diethylene glycol dimethyl ether, and methyl propylene glycol acetate.

2. The method of producing an electrophotographic photosensitive member according to claim 1, wherein the binder resin is a polycarbonate resin or a polyester resin.

3. The method of producing an electrophotographic photosensitive member according to claim 1, wherein the charge transporting substance is a triarylamine compound.

4. The method of producing an electrophotographic photosensitive member according to claim 1, wherein liquid medium further comprises water.

* * * * *